US011110590B1

(12) United States Patent
Tortorella, Jr.

(10) Patent No.: US 11,110,590 B1
(45) Date of Patent: Sep. 7, 2021

(54) ORGANIZER AND WALL MOUNT FOR ORGANIZER

(71) Applicant: Frank Joseph Tortorella, Jr., Park Ridge, IL (US)

(72) Inventor: Frank Joseph Tortorella, Jr., Park Ridge, IL (US)

( * ) Notice: Subject to any disclaimer, the term of this patent is extended or adjusted under 35 U.S.C. 154(b) by 61 days.

(21) Appl. No.: 16/202,732

(22) Filed: Nov. 28, 2018

Related U.S. Application Data

(63) Continuation-in-part of application No. 16/051,439, filed on Jul. 31, 2018, now Pat. No. 11,007,634.

(60) Provisional application No. 62/592,222, filed on Nov. 29, 2017, provisional application No. 62/630,177, filed on Feb. 13, 2018.

(51) Int. Cl.
*B65D 3/00* (2006.01)
*B25H 3/02* (2006.01)

(52) U.S. Cl.
CPC ..... *B25H 3/023* (2013.01)

(58) Field of Classification Search
CPC . B25H 3/023; B25H 3/00; B25H 3/02; B65D 21/0233; B65D 21/02; B65D 21/201
USPC ..... 206/372, 373; 220/23.88, 23.83, 23.89, 220/23.87, 751
See application file for complete search history.

(56) References Cited

U.S. PATENT DOCUMENTS 5,984,441 A * 11/1999 Stokhuijzen ..... B25H 3/023 211/2
8,596,487 B1 * 12/2013 Su ..... B25H 3/06 220/524

* cited by examiner

*Primary Examiner* — Steven A. Reynolds

(57) ABSTRACT

An organizer includes a cup including walls, a movable door and, on an exterior portion thereof, a first connector, the walls defining an interior volume and a first opening to the interior volume, the cup further including a movable door constructed to move between an open position in which the interior volume is accessible via the first opening and a closed position in which the first opening is occluded. The organizer also includes a frame defining a second opening to receive the cup, the frame including a second connector adjacent the second opening to engage the first connector of the cup when the cup is positioned within the second opening and to secure the cup to the frame.

20 Claims, 27 Drawing Sheets

ORGANIZER AND WALL MOUNT FOR ORGANIZER

This disclosure relates generally to an organizer, and, more particularly, to an organizer for tools, components, small parts and/or accessories.

BACKGROUND

Tools are typically housed in a toolbox drawer or tray which may include partitions to define subsections in which tools such as screwdrivers, socket wrenches, sockets and the like may be arranged. When selected tools are required for a task, the entire toolbox is typically moved to the worksite.

Figure 1:
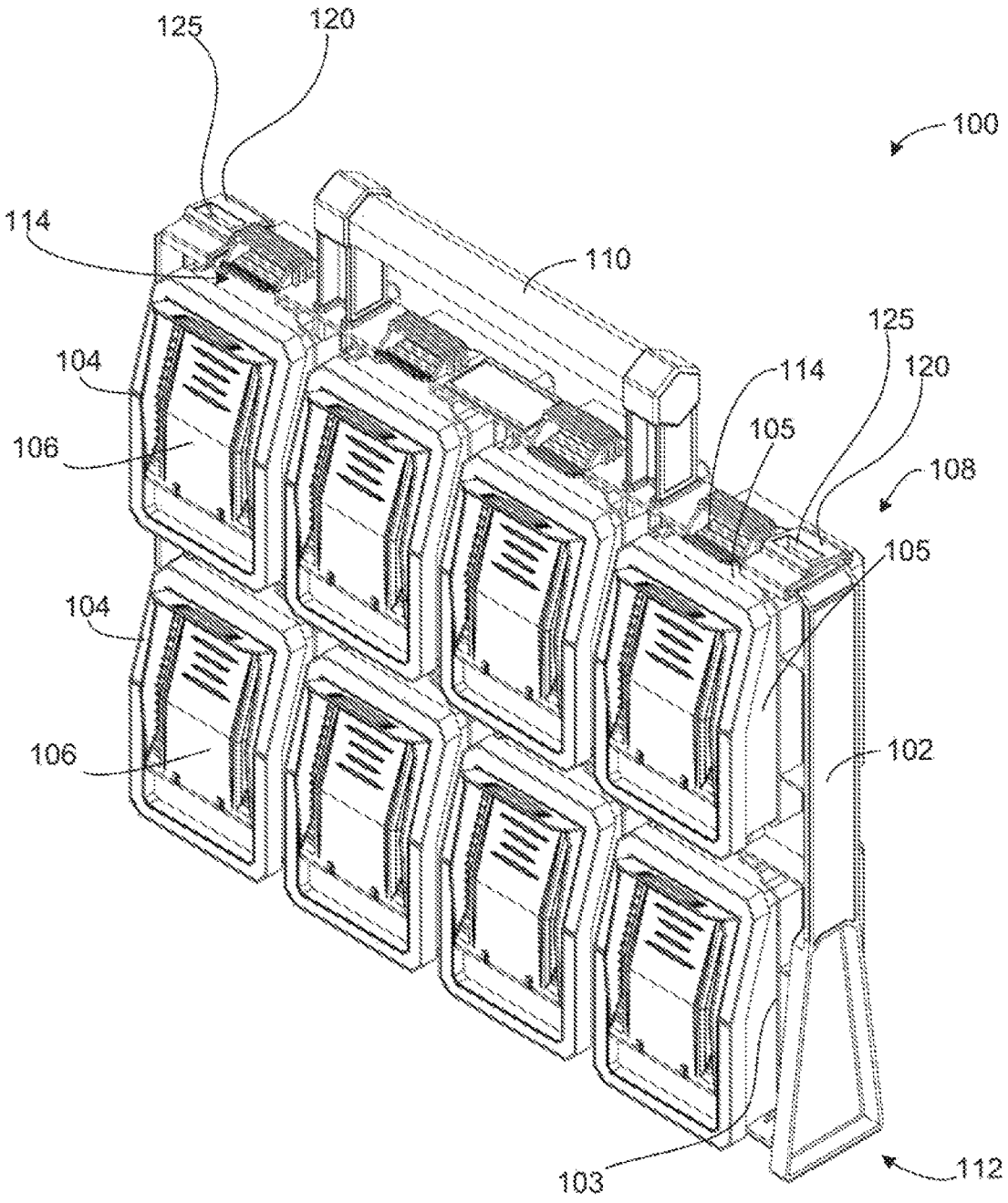
FIG. 1 is a perspective illustration of an example first organizer constructed in accordance with teachings of this disclosure.

The figures are not to scale. Wherever possible, the same reference numbers will be used throughout the drawing(s) and accompanying written description to refer to the same or like parts. As used in this patent, stating that any part is in any way positioned on (e.g., positioned on, located on, disposed on, etc.) another part, indicates that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

A worker at a job site is often required to make one or more trips out to their work truck parked outside of the job site to retrieve additional tools (a drill, a wrench, a screw driver, a socket wrench, etc.) or components, small parts and/or accessories (e.g., sockets, drill bits, electrical tape, twist-on wire couplers, nuts, bolts, washers, etc.) that were not present in the worker's already full toolbox. Generally, the toolbox includes many tools and/or components that are not required for the particular job at hand, but are nonetheless retained within the toolbox for simplicity.

FIG. 1 is a perspective illustration of an example first organizer 100. The first organizer 100 includes an example frame 102 defining a plurality of example openings 103 to receive a corresponding plurality of example cups 104. Each of the cups 104 includes example walls 105 and an example movable door 106. The walls 105 define an interior volume and an opening to the interior volume. The movable door 106 is constructed to move between an open position in which the interior volume is accessible via the opening and a closed position in which the opening is occluded by the movable door 106. In FIG. 1, each movable door 106 for each cup 104 is shown in the closed position.

In the first organizer 100 of FIG. 1, the plurality of example openings 103 defined by the frame 102 includes an array of openings 103 to receive the cups 104. In the example shown, an example upper portion 108 of the frame 102 includes or defines a first array of openings 103 (e.g., a 2×1 array, a 3×1 array, a 4×1 array, etc.) and includes or defines an example handle 110. An example lower portion 112 of the frame 102 defines a second array of openings 103 (e.g., a 2×1 array, a 3×1 array, a 4×1 array, etc.). The frame 102 further includes an example latch 114 adjacent each of the openings 103. The latch 114 is to engage a corresponding connector (not shown in FIG. 1) included on an exterior portion of the cup 104, when the cup 104 is positioned within the respective opening 103, to secure the cup 104 to the frame 102.

At the upper portion 108 of the frame 102 is an example adapter 120 including an example opening 125. In some examples, the adapter 120 is formed as a part of the frame 102. In some examples, the adapter 120 is a separate part that is fixed to the frame 102 or is removably attached thereto. In some examples, the adapter 120 facilitates attachment of the frame 102 to a wall mount bracket as described below.

In some examples, the frame 102, the cups 104, the movable doors 106, the handle 110, the latches 114 and/or the adapters 120 are formed from a plastic (e.g., a Polyethylene Terephthalate (PET), a High Density Polyethylene (HDPE), a Polyvinyl Chloride (PVC), a Low Density Polyethylene (LDPE), a Polypropylene (PP), a Polystyrene (PS), a Polyoxymethylene (POM), etc.) and/or a metal or a metal alloy (e.g., aluminum, steel, etc.).

Figure 2A:
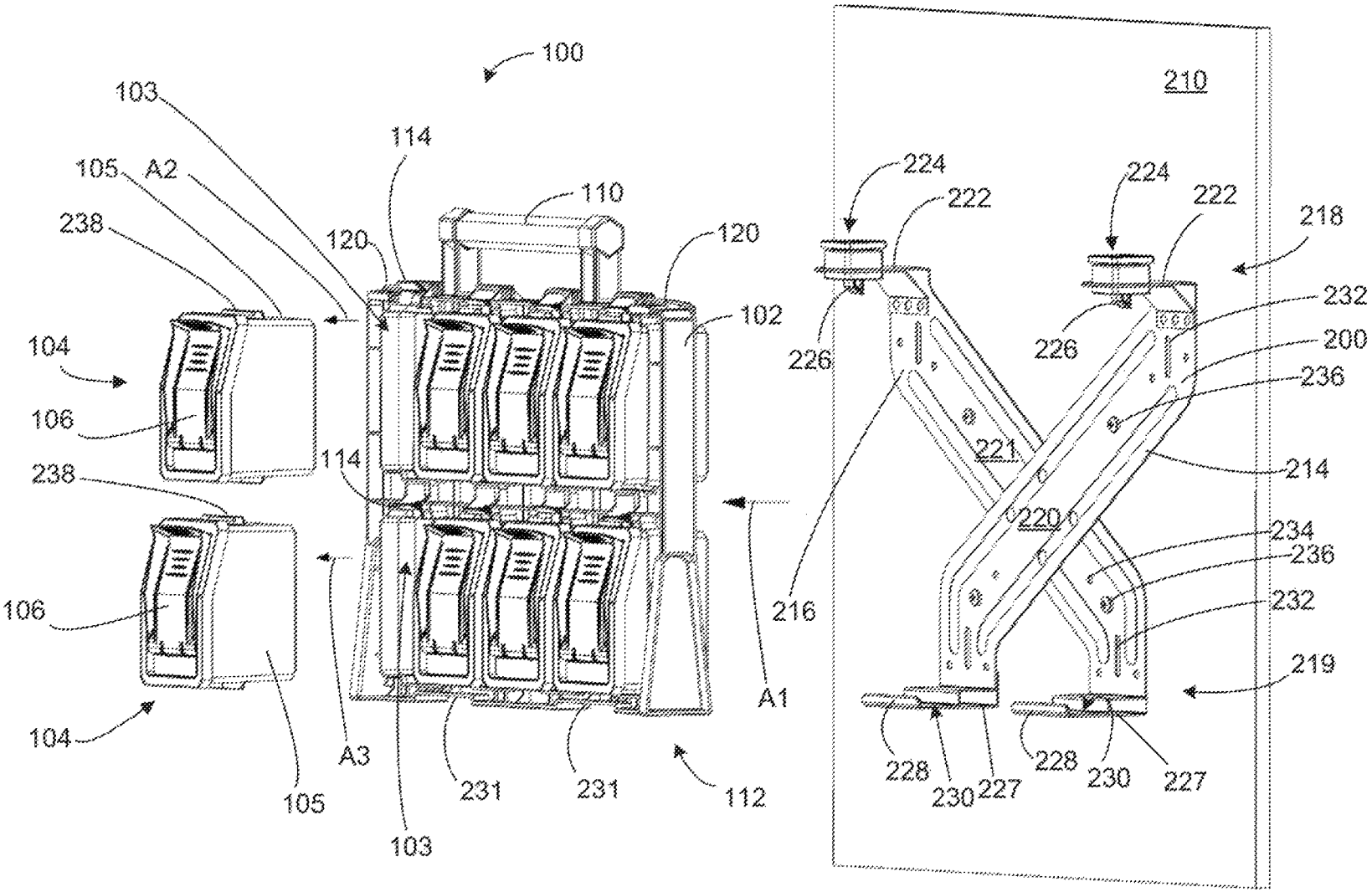
FIG. 2A is an exploded perspective illustration of the first organizer of FIG. 1 showing example removable cups and showing an example wall mount bracket in accordance with teachings of this disclosure.

FIG. 2A is an exploded perspective illustration of the first organizer 100 of FIG. 1, showing the first organizer 100 in relation to an example wall mount bracket 200 attached to an example wall 210, with the example arrow A1 indicating an example removal of the first organizer 100 from the wall mount bracket 200. FIG. 2A also shows two cups 104 removed from corresponding openings 103 of the first organizer 100, as represented by the arrows A2 and A3, respectively. To illustrate, the two cups 104 that are shown to be removed in FIG. 2A may be replaced by two different cups 104 (not shown) containing two different types of components, small parts and/or accessories (e.g., sockets, drill bits, electrical tape, twist-on wire couplers, nuts, bolts, washers, etc.) that are deemed necessary by a worker for a particular job. In some examples, a worker's truck includes all components, small parts and/or accessories (e.g., sockets, drill bits, electrical tape, twist-on wire couplers, nuts, bolts, washers, etc.) in cups 104 disposed in one or more racks which include a frame defining openings to receive the cups 104. In some examples, the rack(s) are a larger version of the frame 102.

The wall mount bracket 200 of FIG. 2A includes an example first section 214 attached to, or integrally formed with, an example second section 216. In some examples, wall mount bracket 200, the first section 214 of the wall mount bracket 200 and/or the second section 216 of the wall mount bracket 200 are formed from a plastic (e.g., PET, HDPE, PVC, LDPE, PP, PS, POM, etc.) and/or a metal or a metal alloy (e.g., aluminum, steel, etc.). In the example form factor depicted, the first section 214 and the second section 216 form a generally X-shaped wall mount bracket 200. In other examples, the wall mount bracket 200 includes a rectangular frame dimensioned to receive the frame 102 of the first organizer 100. In some examples, the wall mount bracket 200 includes an upper section and a lower section that are separate from one another (e.g., a substantially parallel upper bracket and lower bracket each separately mounted to the wall 210, etc.).

The wall mount bracket 200 includes an example upper portion 218 and an example lower portion 219. In some examples, the first section 214 includes an example base 220 constructed to attach to the wall 210 and/or to the second section 216 and the second section 216 includes an example base 221 constructed to attach to the wall 210 and/or to the first section 214. The upper portion 218 of the wall mount bracket 200 includes an example first pair of arms 222 extending outwardly from the base 220 and the base 221. In some examples, the first pair of arms 222 extends outwardly, from proximal ends at the base 220 and the base 221, substantially perpendicular to the base 220 and the base 221 (plus or minus 1 degree, plus or minus 2 degrees, plus or minus 3 degrees, etc.). At distal ends of the first pair of arms 222 are quick release connectors 224 having movable pins 226 to engage the adapter 120 and/or the opening 125 of the adapter 120 and releasably secure the frame 102 via engagement of the connectors (e.g., movable pins 226 engaging the opening 125 of the adapter 120, etc.). For example, the movable pins 226 are constructed to fit within the opening 125 of the adapter 120. In some examples, the movable pins 226 are spring-loaded with springs biasing the movable pins 226 in a downward direction to facilitate connection of the movable pins 226 to the adapter 120 and/or the opening 125 of the adapter 120.

The lower portion 219 of the wall mount bracket 200 includes an example second pair of arms 227 extending outwardly from the base 220 and the base 221. In some examples, the second pair of arms 227 extends outwardly from the base 220 and the base 221 substantially perpendicular to the base (plus or minus 1 degree, plus or minus 2 degrees, plus or minus 3 degrees, etc.). In some examples, the second pair of arms 227 extends outwardly, from proximal ends at the base 220 and the base 221, substantially perpendicular to the base 220 and the base 221 (plus or minus 1 degree, plus or minus 2 degrees, plus or minus 3 degrees, etc.). At distal ends of the second pair of arms 227 are provided example lateral retainers 228 and example supports 230 dimensioned to engage corresponding example features 231 (e.g., a recessed portion, etc.) at the lower portion 112 of the frame 102. In the example shown in FIG. 2A, the supports 230 take the form of substantially flat sections of the second pair of arms 227 that are received within the features 231, with the lateral retainers 228 extending beyond the features 231 to engage a front portion of the frame 102. In some examples, the lateral retainers 228 curve upwardly to engage a front portion of the frame 102 and prevent movement of the lower portion 112 of the first organizer 100 away from the base 220 and the base 221 of the wall mount bracket 200. Likewise, the movable pins 226 engage the adapters 120 and/or the openings 125 of the adapters 120 at the upper portion 108 of the frame 102 to prevent movement of the upper portion 108 of the first organizer 100 away from the base 220 and the base 221 of the wall mount bracket 200 during such engagement.

In some examples, the movable pins 226 are constructed to fit within the openings 125 of the adapters 120. In some examples, the quick release connectors 224 are spring-loaded to bias the movable pins 226 (e.g., in a downward direction, etc.) to facilitate automatic connection of the movable pins 226 to the adapter 120 and/or the opening 125 of the adapter 120 once the example first organizer 100 is properly positioned within the wall mount bracket 200 to thereby releasably secure the frame 102 to the wall mount bracket 200 via engagement of the connectors (e.g., movable pins 226 engaging the opening 125 of the adapter 120, etc.).

In some examples, to facilitate positioning of the wall mount bracket 200 on the wall 210 and/or to ease installation, the first section 214 and/or the second section 216 include one or more through example slots 232, in one or more portions of the first section 214 and/or the second section 216, through which an example fastener (not shown) may be disposed to secure to the wall 210. The slots 232, which are shown as example vertical slots, facilitate alignment of fasteners at different points along an axis of the slots 232. In some examples, to facilitate mounting of the wall mount bracket 200 to the wall 210, the first section 214 and/or the second section 216 include one or more example through holes 234, in one or more portions of the first section 214 and/or the second section 216, through which an example fastener 236 may be disposed to secure to the wall 210.

FIG. 2A shows example connectors 238 included on an exterior portion of the cups 104. When the cups 104 are positioned within a respective opening 103, the cup 104 is secured to the frame 102 via an engagement of the latch 114 adjacent the opening 103 and the connector 238 of the cup. In some examples, the connector 238 includes a rib extending upwardly from an upper surface of the cup 104.

To illustrate attachment of the first organizer 100 to the wall mount bracket 200, the lower portion 112 of the frame 102 of the first organizer 100 is positioned so that the features 231 are aligned with the second pair of arms 227 so that the features 231 engage (e.g., rest upon, etc.) the supports 230. With the lower portion 112 of the frame 102 positioned in the supports 230, the upper portion 108 of the frame 102 is pivoted toward the wall mount bracket 200, whereupon the adapters 120 engage the pins 226 to bias the pins 226 upwardly into the quick release connectors 224 until the openings 125 are positioned below the pins 226, at which point the pins 226 will be biased (e.g., by spring force or force of another resilient member, etc.) into the openings 125, thereby locking the upper portion 108 of the frame 102 into the wall mount bracket 200. To reverse the process and remove the first organizer 100 from the wall mount bracket 200, an upper portion of the quick release connectors 224 are moved upwardly to correspondingly move the pins 226 upwardly until the pins 226 clear the openings 125, enabling movement of the upper portion 108 of the frame 102 away from the wall mount bracket 200. The first organizer 100 may then be lifted away from the wall mount bracket 200 to disengage the features 231 at the lower portion 112 of the frame 102 from the second pair of arms 227.

Figure 2B:
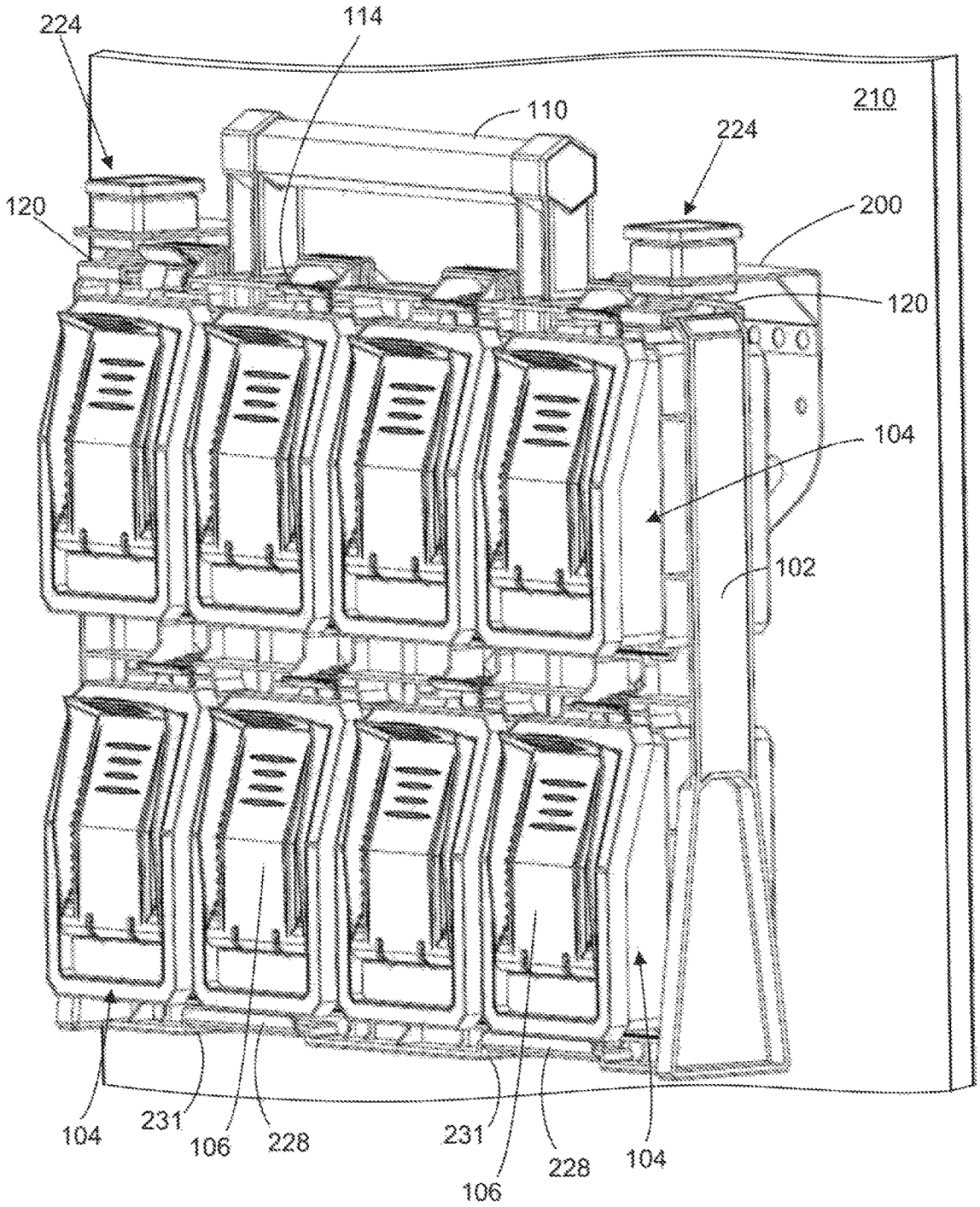
FIG. 2B is a perspective illustration of the first organizer of FIG. 1 removably attached to the wall mount bracket of FIG. 2A in accordance with teachings of this disclosure.

FIG. 2B is a perspective illustration of the first organizer 100 of FIG. 1 and FIG. 2A removably attached to the wall mount bracket 200 of FIG. 2A. As shown in FIG. 2B, the frame 102 is positioned so that the features 231 are aligned with the second pair of arms 227 and engage the supports 230 with the lateral retainers 228 extending beyond the features 231 to engage a front portion of the frame 102. The adapters 120 are engaged by the pins 226 of the quick release connectors 224, which locks the upper portion of the frame 102 into the wall mount bracket 200. In some examples, FIG. 2B represent a portion of a wall 210 of a work van and the first organizer 100 is positioned on the wall mount bracket 200 for transport. In some examples, FIG. 2B represents a portion of a wall 210 of a home, garage or workshop.

Figure 2C:
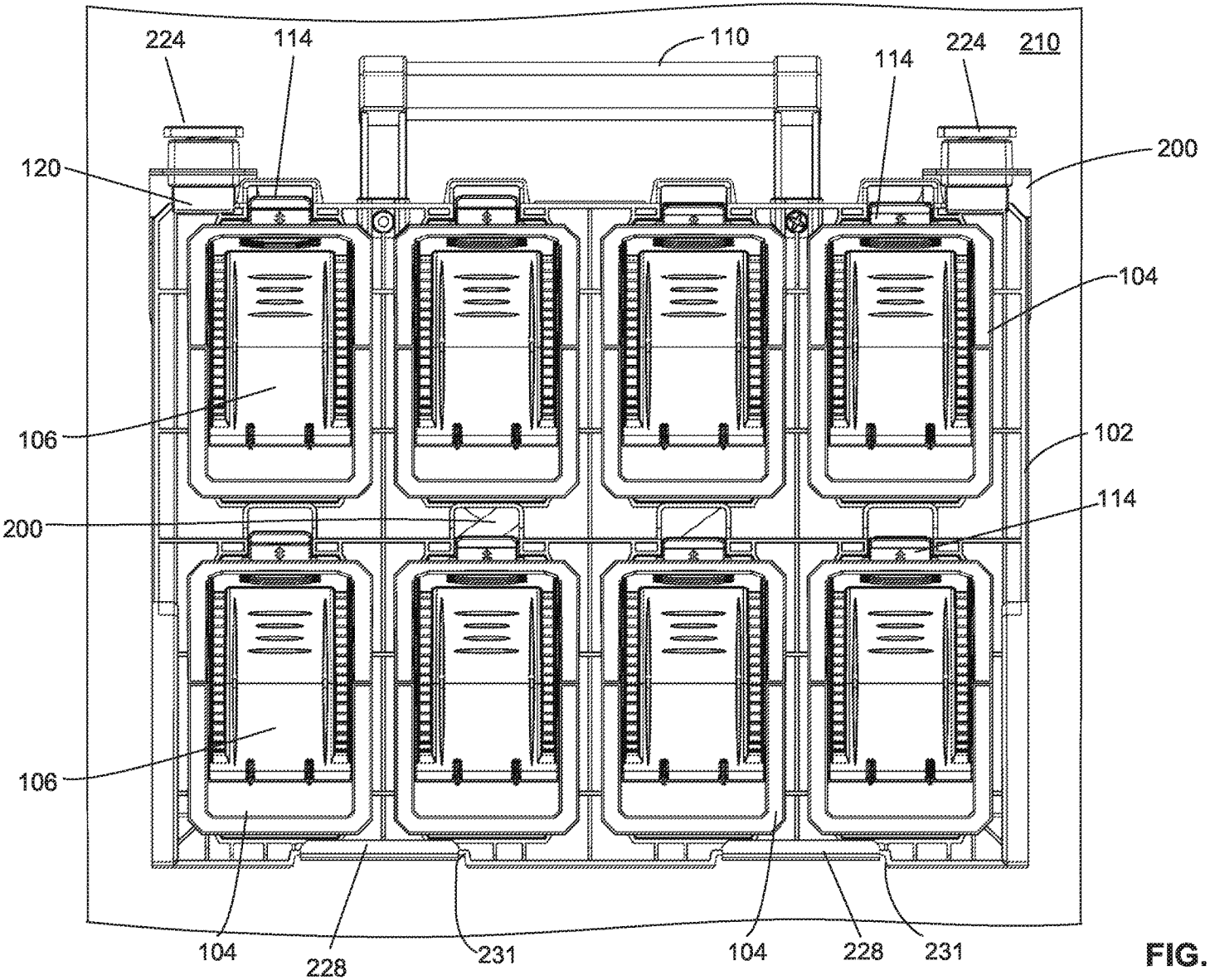
FIG. 2C is a front view of the first organizer of FIG. 1 and FIGS. 2A-2B removably attached to the wall mount bracket of FIGS. 2A-2B in accordance with teachings of this disclosure.

FIG. 2C is a front view of the first organizer 100 of FIG. 1 and FIGS. 2A-2B removably attached to the wall mount bracket 200 of FIGS. 2A-2B. FIG. 2C shows engagement of the frame 102 by the lateral retainers 228 at a lower portion of the first organizer 100 and engagement of the adapters 120 of the frame 102 by the quick release connectors 224 at an upper portion of the first organizer 100.

Figure 2D:
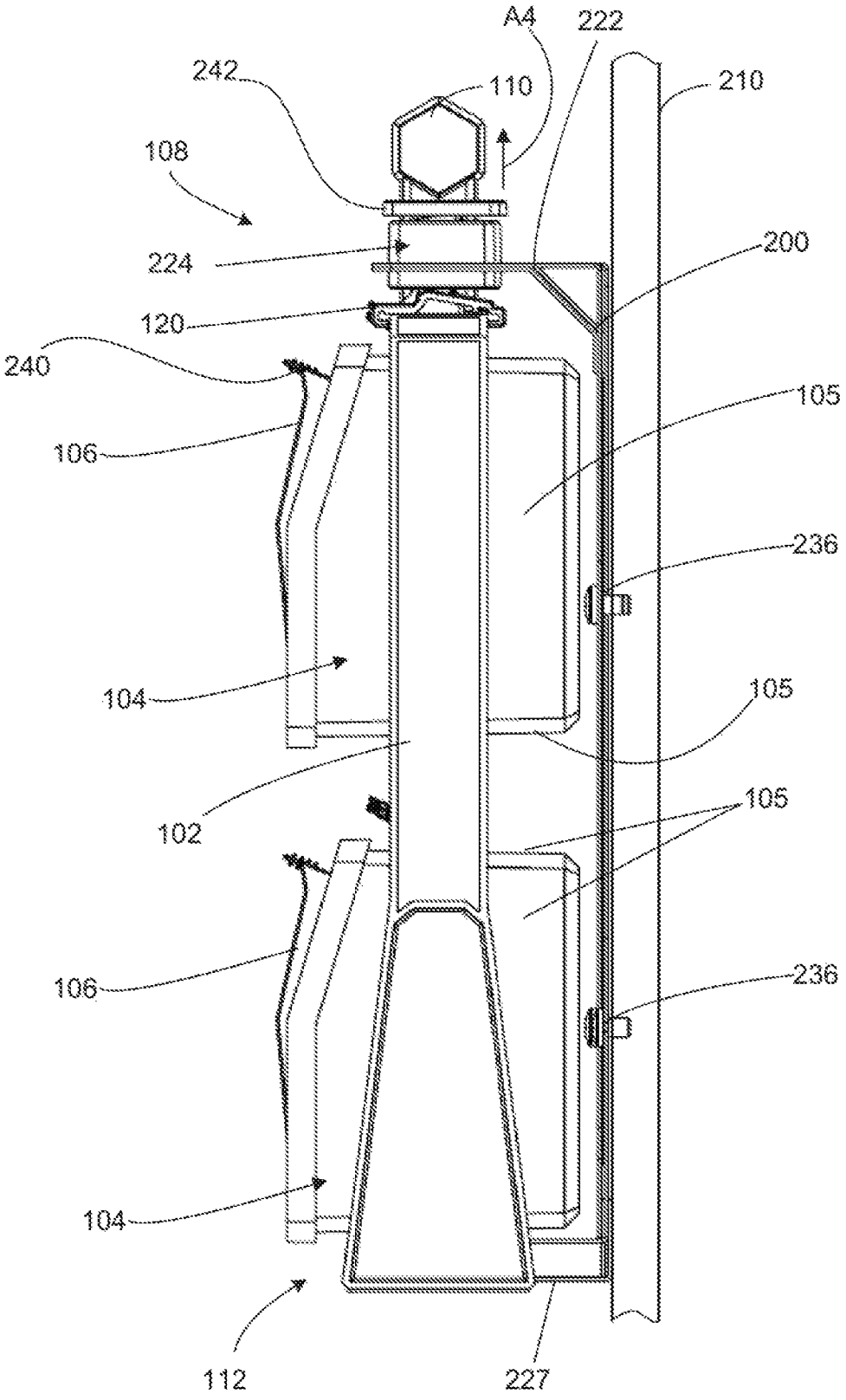
FIG. 2D is a side view of the first organizer of FIG. 1 and FIGS. 2A-2C removably attached to the wall mount bracket of FIGS. 2A-2C in accordance with teachings of this disclosure.

FIG. 2D is a side view of the first organizer 100 of FIG. 1 and FIGS. 2A-2B removably attached to the wall mount bracket 200 of FIGS. 2A-2C. The side view of FIG. 2D shows, for example, the upper portion 108 of the frame 102 and the adapter 120 in relation to the quick release connector 224 and the lower portion 112 of the frame 102 to an arm of the second pair of arms 227. The wall mount bracket 200 is shown to be secured to the wall 210 via fasteners 236 (e.g., screws, etc.) positioned in slots 232 and/or through holes 234. The quick release connector 224 is shown to include an example actuator 242 that may be moved upwardly in the direction of the example arrow A4 to pull the pin 226 of the quick release connector 224 out of engagement with the opening 125 of the adapter 120 to release the frame 102 of the first organizer 100 from the quick release connector 224. FIG. 2D also shows an example handle 240 of the movable door 106.

Figure 2E:
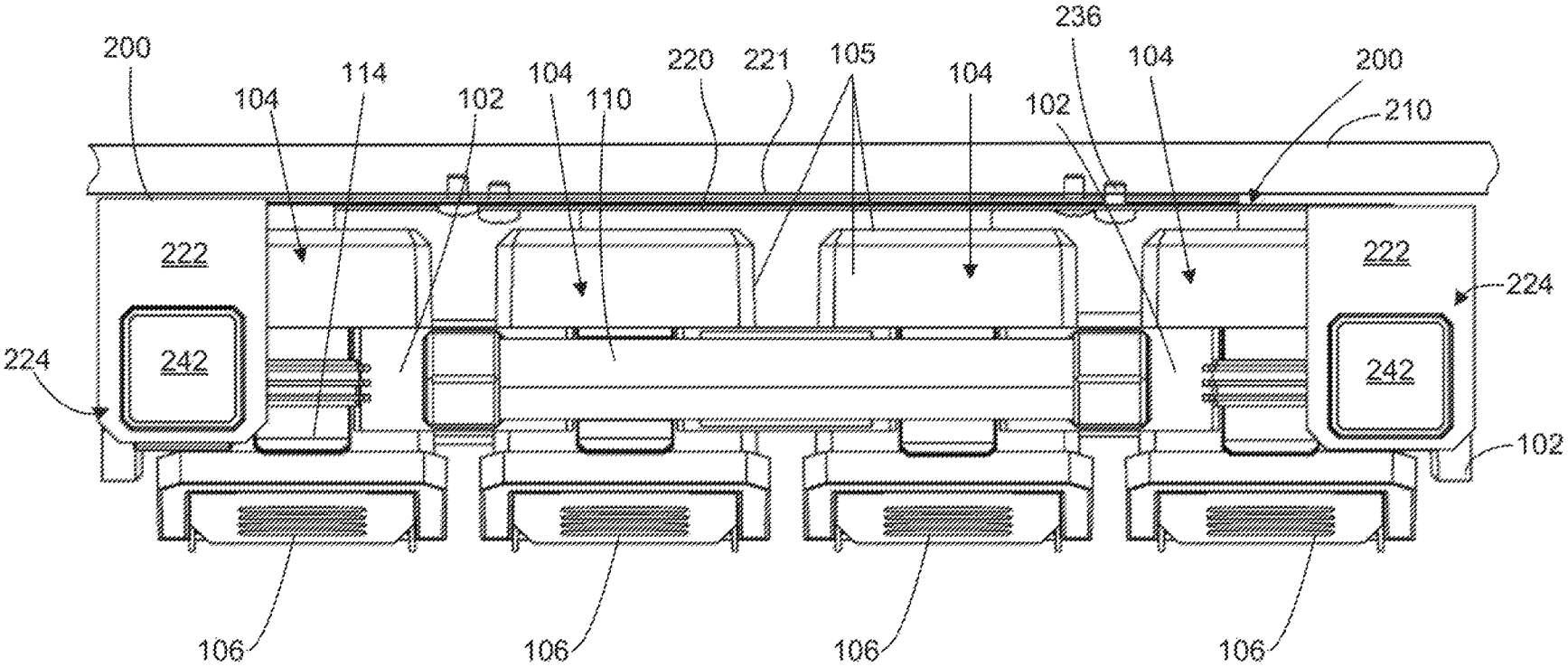
FIG. 2E is a top view of the first organizer of FIG. 1 and FIGS. 2A-2D removably attached to the wall mount bracket of FIGS. 2A-2D in accordance with teachings of this disclosure.

FIG. 2E is a top view of the first organizer 100 of FIG. 1 and FIGS. 2A-2D removably attached to the wall mount bracket 200 of FIGS. 2A-2D. The cups 104 are disposed in the frame 102 and are secured in place relative to the frame 102 via the latches 114, which engage corresponding connectors (not shown) on an exterior upper portion of the cup 104. FIG. 2E shows the first pair of arms 222 extending outwardly from the base 220 and the base 221, with the quick release connectors 224 provided at the distal ends of the first pair of arms 222. The wall mount bracket 200 is shown to be secured to the wall 210 via fasteners 236 (e.g., screws, etc.) positioned in the slots 232 and/or the through holes 234 (not shown).

Figure 2F:
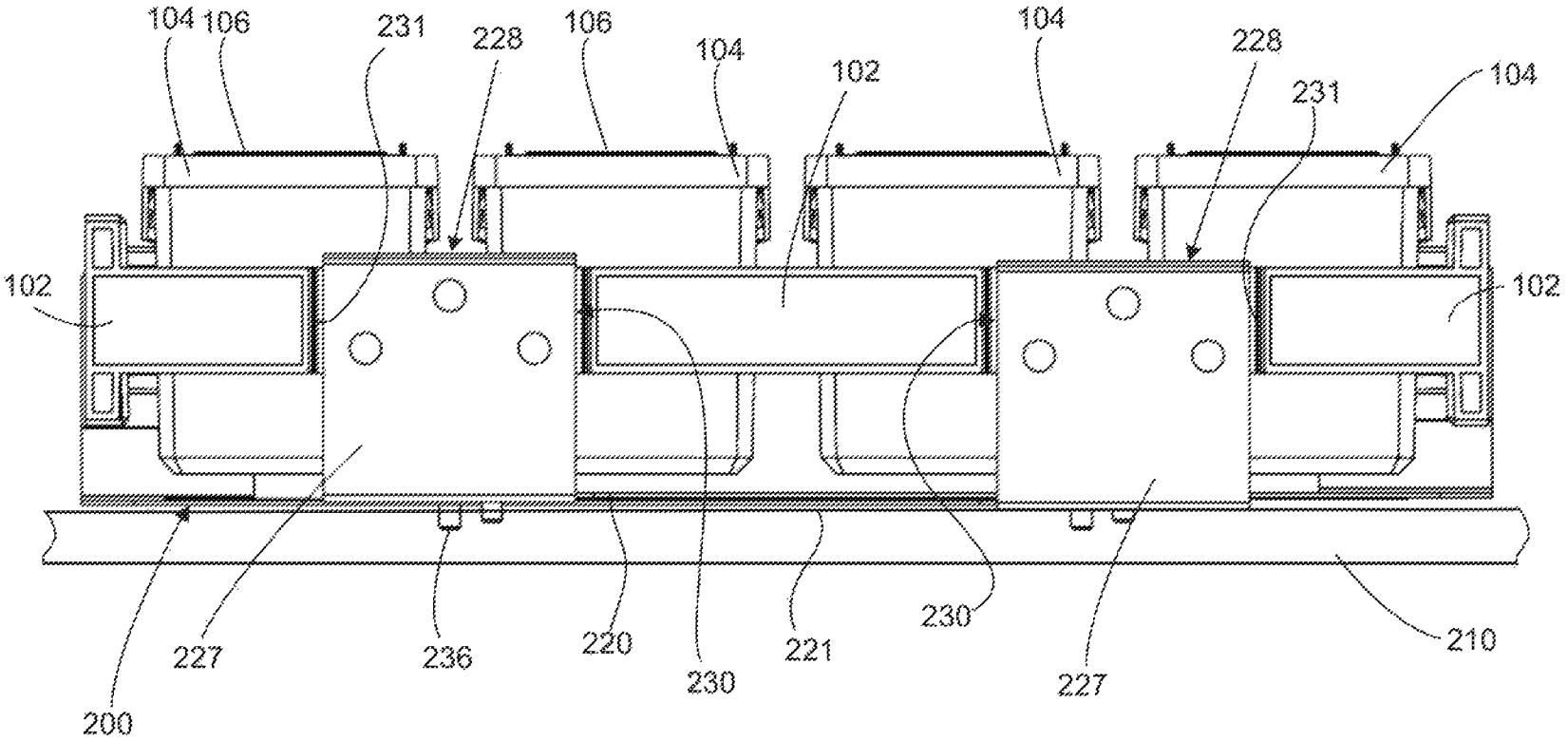
FIG. 2F is a bottom view of the first organizer of FIG. 1 and FIGS. 2A-2E removably attached to the wall mount bracket of FIGS. 2A-2E in accordance with teachings of this disclosure.

FIG. 2F is a bottom view of the first organizer 100 of FIG. 1 and FIGS. 2A-2E removably attached to the wall mount bracket 200 of FIGS. 2A-2E. The second pair of arms 227 are shown to extend outwardly from the base 220 and the base 221 relative to the wall 210 to terminate, at distal ends of the second pair of arms 227, with the lateral retainers 228. The supports 230 of the second pair of arms 227 engage corresponding features 231 of the frame 102 to prevent movement of the lower portion 112 of the first organizer 100 relative to the base 220 and the base 221 of the wall mount bracket 200.

Figure 2G:
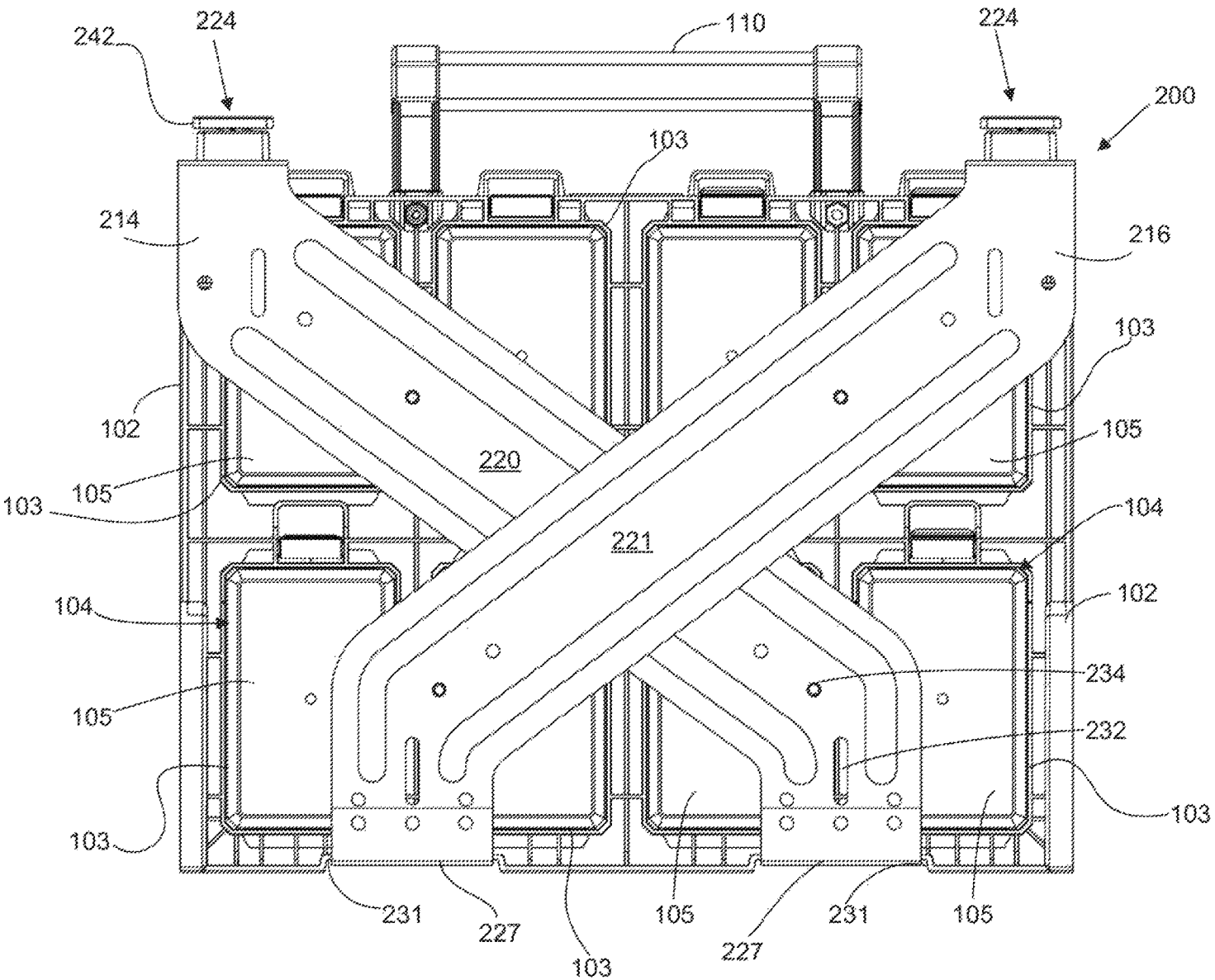
FIG. 2G is a rear view of the first organizer of FIG. 1 and FIGS. 2A-2F removably attached to the wall mount bracket of FIGS. 2A-2F, with the example wall removed for clarity, in accordance with teachings of this disclosure.

FIG. 2G is a rear view of the first organizer 100 of FIG. 1 and FIGS. 2A-2F removably attached to the wall mount bracket 200 of FIGS. 2A-2F, with the wall 210 removed for clarity. FIG. 2G shows the first section 214 and the second section 216 of the wall mount bracket 200, as well as the slots 232 and through holes 234 by which the wall mount bracket 200 may be mounted to the wall. In some examples, the wall mount bracket 200 may omit the example slots 232 and through holes 234 in favor or an adhesive connection between the wall mount bracket 200 and the wall. FIG. 2G also shows the openings 103 defined by the frame 102 to receive the cups 104.

In some examples, the wall mount bracket 200 is omitted and the first organizer 100 is mounted to the wall via a bracket or hanger that engages the handle 110 or other feature of the frame 102. For instance, the first organizer 100 may be placed in or attached to a hanger hook or a clamp mounted to the wall.

Figure 3A:
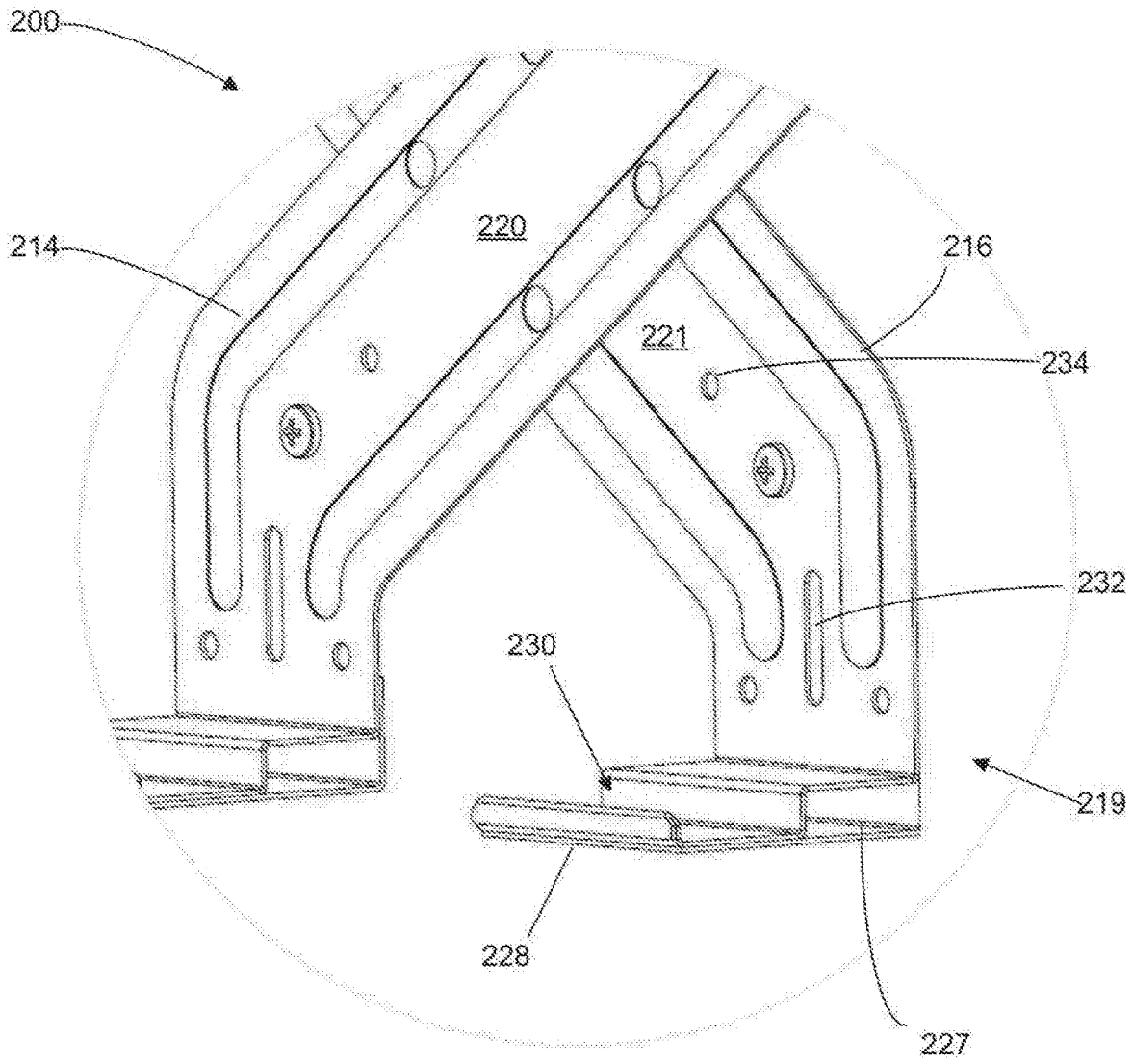
FIG. 3A is a perspective illustration of a lower portion of the wall mount bracket of FIGS. 2A-2G in accordance with teachings of this disclosure.
Figure 3C:
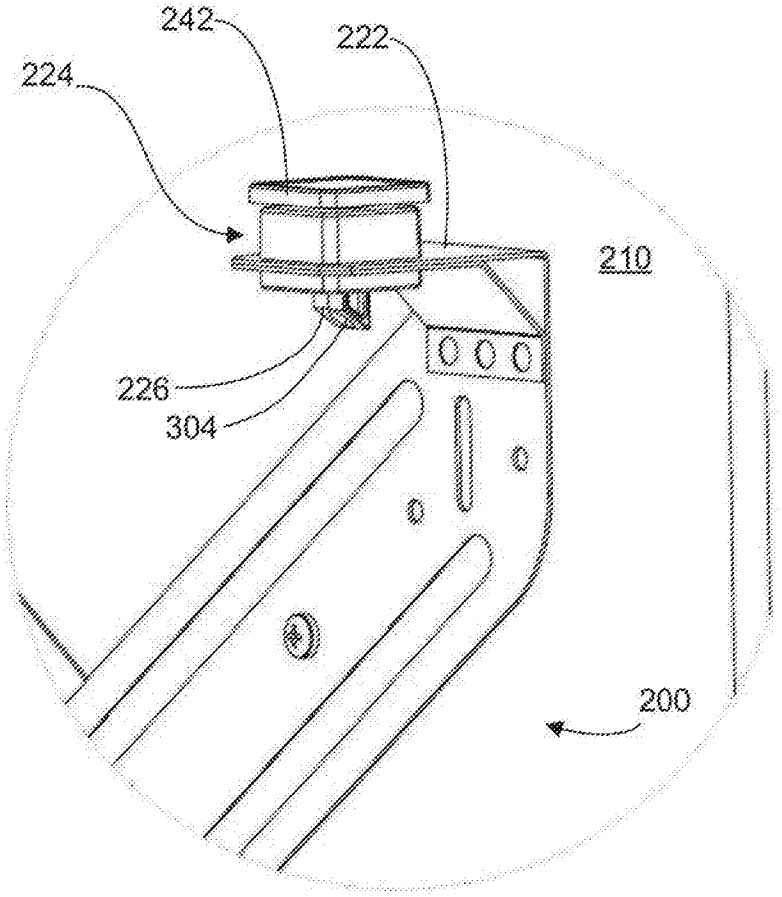
FIG. 3C is a perspective illustration of an example quick release connector at an example upper portion of the wall mount bracket of FIGS. 2A-2G in accordance with teachings of this disclosure.

FIG. 3A is a perspective illustration of a lower portion of the wall mount bracket 200 of FIGS. 2A-2G showing portions of the first section 214 and the second section 216 and showing an example configuration of the second pair of arms 227 extending outwardly from the base 220 of the first section 214 and the base 221 of the second section 216. The distal end of the arm 227 extending outwardly from the base 221 shows the lateral retainer 228 curving upwardly to a position where the lateral retainer 228 can engage a front portion of the frame 102 to prevent movement of the lower portion 112 of the first organizer 100 forward relative to the support 230. In some examples, the support 230 takes the form of a slot formed within the arm 227. In some examples, the lateral retainer 228 takes the form of one or more protuberances or male members disposed not at the distal end of the arm 227, but rather at the support 230, to extend upwardly relative to the support 230 to engage a corresponding recess or recesses formed in the features 231 at the lower portion 112 of the frame 102.

Figure 3B:
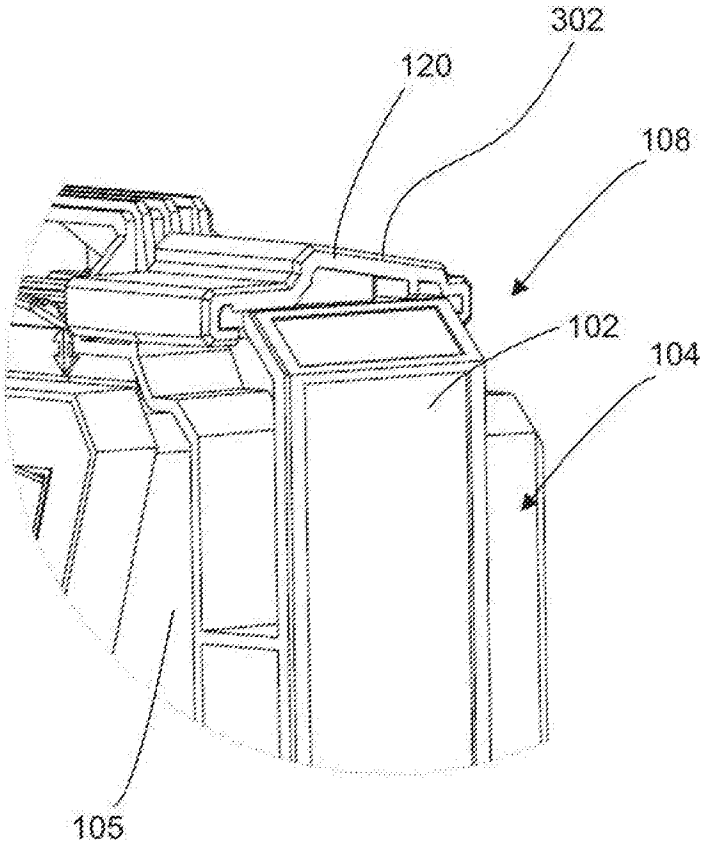
FIG. 3B is a perspective illustration of an upper portion of an example frame for the first organizer of FIG. 1 and FIGS. 2A-2G in accordance with teachings of this disclosure.

FIG. 3B is a perspective illustration of the upper portion 108 of the frame 102 of the first organizer 100 of FIG. 1 and FIGS. 2A-2G and FIG. 3C is a perspective illustration of the quick release connector 224 at the upper portion of the wall mount bracket 200 of FIGS. 2A-2G. The adapter 120 of FIG. 3B is shown to have an example sloped surface 302 generally corresponding to a sloped surface 304 of pin 226. As the adapter 120 is brought into contact with the pin 226 during mounting of the first organizer 100 in the wall mount bracket 200, the pin 226 slides against the sloped surface 302 and is biased upwardly against a spring force biasing the pin 226 downwardly. When the pin 226 encounters the opening 125 in the adapter 120, the pin 226 then springs into the opening 125 to lock the frame 102 relative to the quick release connector 224 and the wall mount bracket 200. The actuator 242 of the quick release connector 224 can be moved upwardly to move the pin 226 out of engagement with the opening 125 in the adapter 120 to enable movement of the frame 102 relative to the quick release connector 224 and the wall mount bracket 200.

Figure 3D:
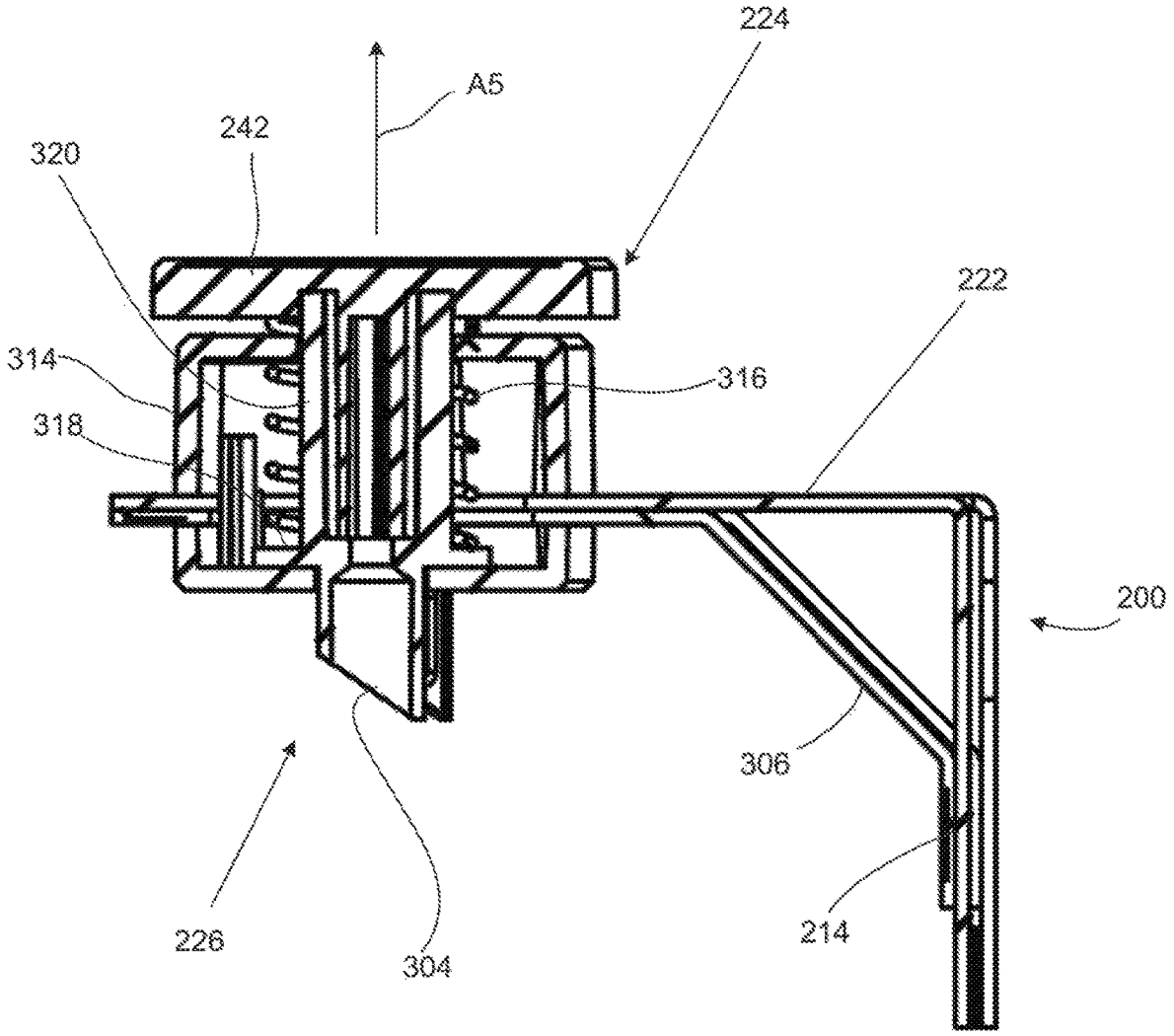
FIG. 3D is a cut-away side view of the example quick release connector of FIG. 3C in accordance with teachings of this disclosure.

FIG. 3D is a cut-away side view of the quick release connector 224 of FIGS. 2A-2G and FIG. 3C. In some examples, an example support 306 is used to support the arm 222 and maintain an angular relation between the arm 222 and the first section 214 of the wall mount bracket 200. FIG. 3D shows the sloped surface 302 of the pin 226. The quick release connector 224 includes an example housing 314 integrated with or attached to the arm 222. An example resilient element 316 (e.g., a spring, etc.) is disposed within the housing 314 to engage an example boss 318 of the pin 226 at a first end and to engage an interior surface of the housing 314 at a second end to bias the pin 226 downwardly into the depicted position. An example body 320 of the pin 226 extends upwardly through the housing 314 to connect to the actuator 242. When the actuator 242 is displaced upwardly in the direction of the example arrow A5, the boss 318 of the pin 226 compresses the resilient element 316 and the pin 226 moves upwardly within the housing 314. When the force on the actuator 242 is released, the resilient element 316 releases its stored energy and biases the boss 318 and the pin 226 downwardly until the boss 318 encounters surfaces of the housing 314 the prevent further movement of the pin 226.

Figure 3E:
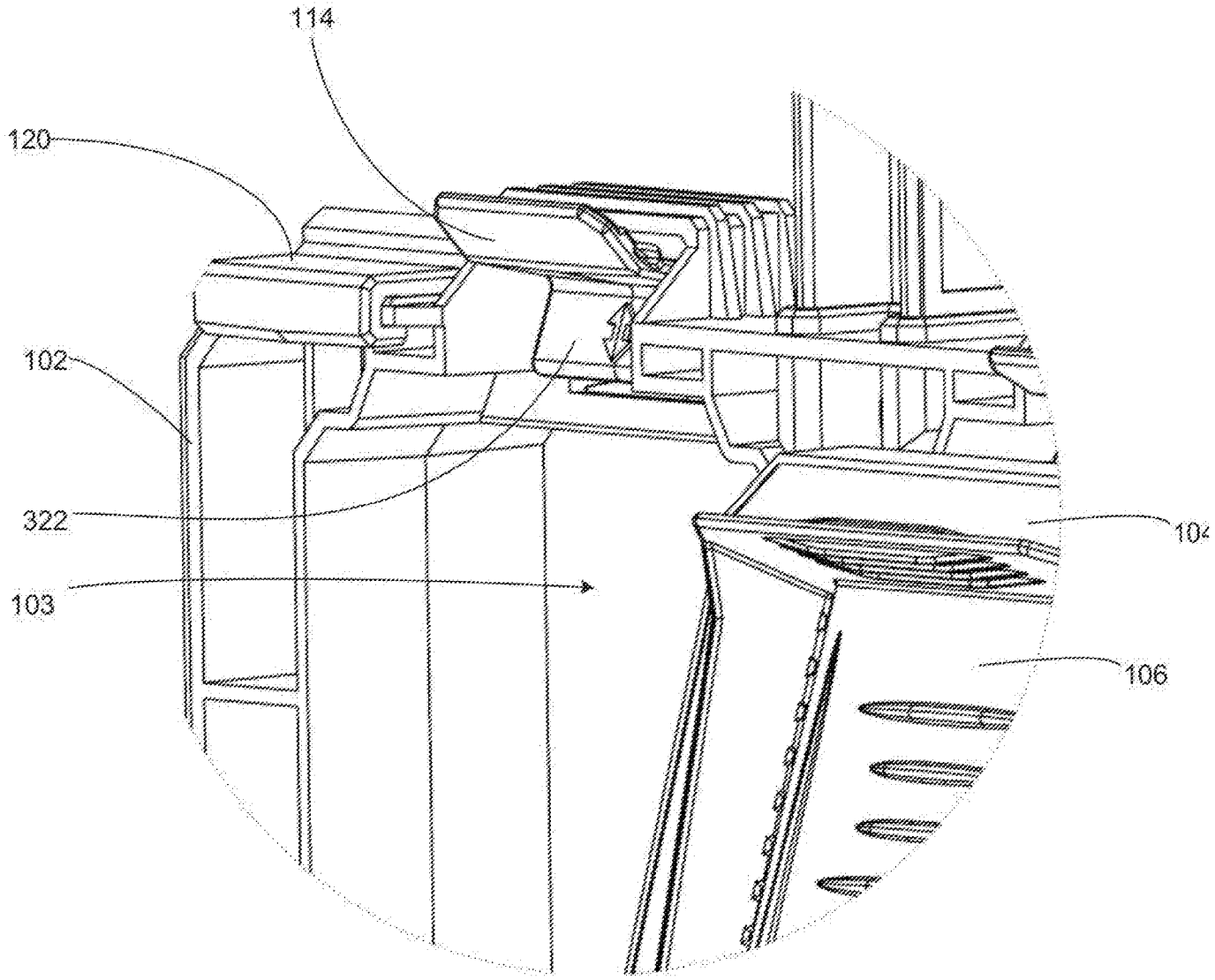
FIG. 3E is a perspective illustration of an example connector to connect the example cup of FIG. 1 to the example frame of the example first organizer of FIG. 1 and FIGS. 2A-2G in accordance with teachings of this disclosure.

FIG. 3E is a perspective illustration of an example latch 114 to connect the example cup 104 of FIG. 1 and FIGS. 2A-2G to the frame 102 of the first organizer 100 of FIG. 1 and FIGS. 2A-2G. In some examples, the latch 114 includes an example latch 322 downwardly depending therefrom. In some examples, the latch 114 is rotatable relative to the frame 102 and is attached to a hinge or is rotatably attached to a pin. As shown, the latch 114 is in a raised position, wherein the latch element 322 is positioned so as to enable removal of the cup 104 from the opening 103. Following positioning of a cup 104 within the opening 103, the latch 114 is rotated downwardly to move the latch element 322 into engagement with the connector 238 on the cup 104 inserted into the opening 103. For instance, the latch element 322 is biased against the connector 238 as the latch 114 is rotated downwardly. Correspondingly, to enable removal of a cup 104 from the opening 103 of the frame 102, the latch 114 is rotated upwardly to move the latch element 322 out of engagement with the connector 238 on the exterior portion of the cup 104.

Figure 4B:
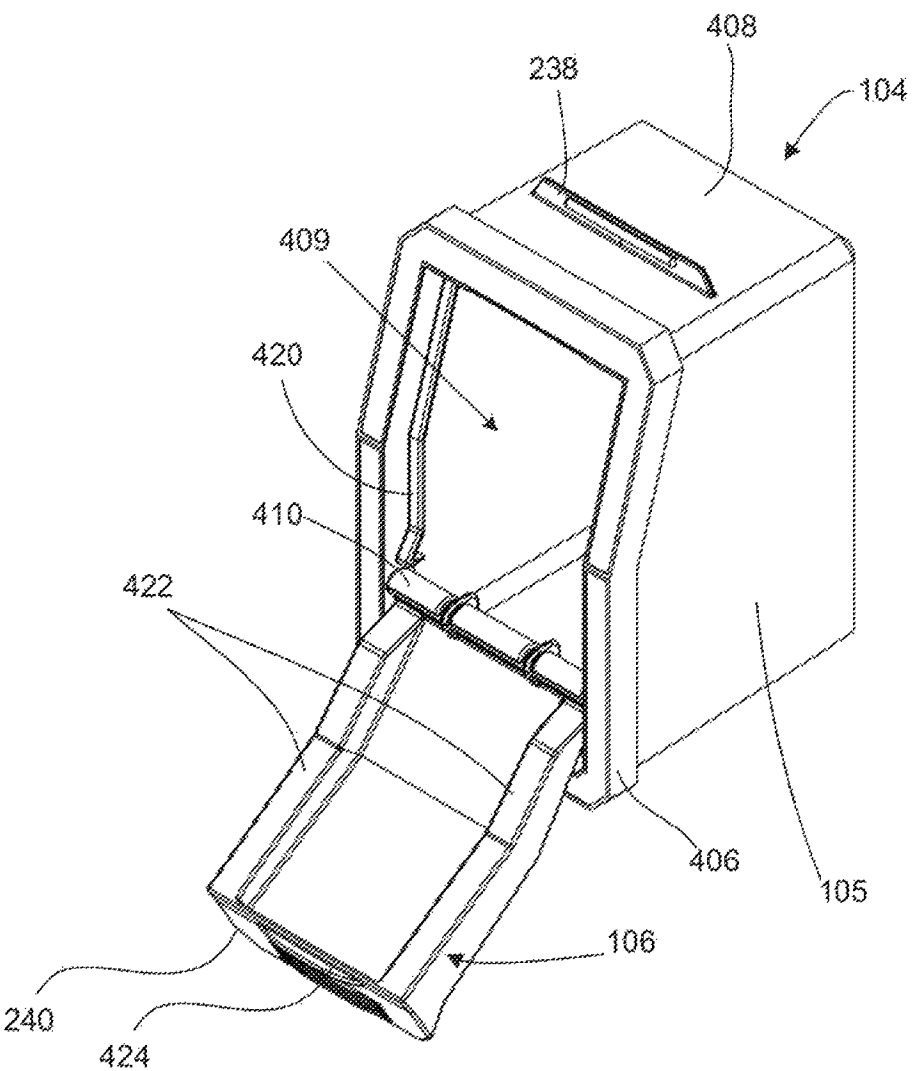
FIGS. 4A-4B are perspective illustrations of the example cup of FIG. 1 and FIGS. 2A-2G with an example movable door in a closed position and an open position, respectively, in accordance with teachings of this disclosure.
Figure 4A:
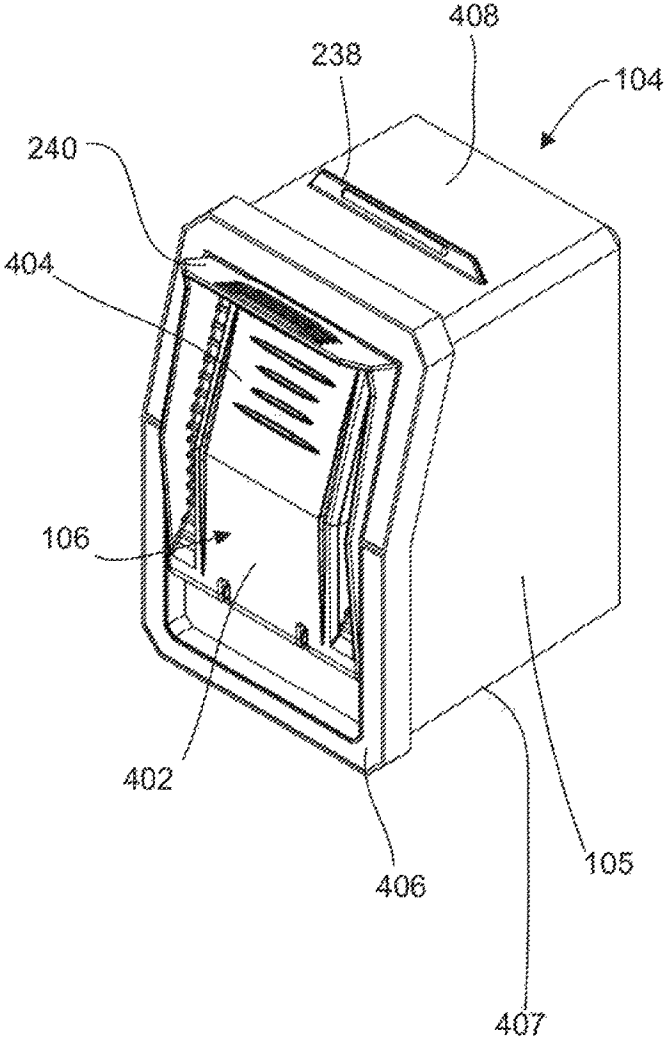

FIGS. 4A-4B are perspective illustrations of the example cup 104 of FIG. 1 and FIGS. 2A-2G. FIG. 4A shows the movable door 106 of the cup 104 in a closed position and FIG. 4B shows the movable door 106 of the cup 104 an open position. In some examples, the movable door 106 includes an example lower portion 402 and an example upper portion 404 arranged at an angle relative to one another. For instance, as shown in FIG. 4A, the upper portion 404 is angled rearwardly (e.g., toward a rear of the cup 104) relative to the lower portion 402 to generally match a shape of an example bezel 406 of the cup 104 and a shape of the cup 104. The cup 104 is shown to have an example lower portion 407 that is larger (e.g., deeper, longer, etc.) that an example upper portion 408. In this configuration, the cup 104 is stable when removed from the frame 102 and disposed on a surface, such as a work table or counter. Additionally, the example interior volume 409 of the cup 104, shown in part in FIG. 4B, has a larger cross-sectional area in the lower portion 407 as compared to that of the upper portion 408. Consequently, when the interior volume 409 is filled with components, small parts and/or accessories, for example, a center of gravity of the filled or partially-filled cup 104 is below a middle of a height of the cup 104, which contributes to stability of the cup 104 when removed from the frame 102. In some examples, a bottom portion of the bezel 406 is flush with the lower portion 407 of the cup 104 so that the bottom surface of the cup 104 is substantially planar. In some examples, the lower portion 407 of the cup 104 includes a connector, a rib, a stand, or a male member or protuberance that extends downwardly by a height generally corresponding to that of a height of the bezel 406 from the bottom surface of the cup 104 to provide one or more additional points of contact on the bottom surface of the cup 104.

FIG. 4B shows an example hinge 410 about which the movable door 106 rotates. FIG. 4B shows a portion of an example interior stop 420 of the cup 104 that engages one or more example features 422 of the movable door 106 to stop movement of the movable door 106 in the closing direction. In the example of FIG. 4B, the features 422 include raised areas structured to matingly engage the stop 420 at one or more areas. In some examples, the features 422 are to matingly engage the stop 420 along a periphery of the interior volume so as to provide a generally sealing engagement therebetween. In some examples, the features 422 and/or the stop 420 includes a gasket or resilient element to facilitate formation of a seal along the periphery of the interior volume. In some examples, the movable door 106 includes an example protrusion 424 to serve as a snap-fit connector to engage with a corresponding recess in the bezel 406 to lock the movable door 106 in place. In some examples, the movable door 106 or the bezel 406 includes a latch to lock the movable door 106 in place. In some examples, the movable door 106 frictionally engages the bezel 406 to provide resistance to movement of the movable door 106 along a portion of a range of angular movement of the movable door 106 (e.g., along the first 5°-10° of movement of the movable door in the opening direction, etc.) or along an entire range of angular movement of the movable door 106.

Figure 4D:
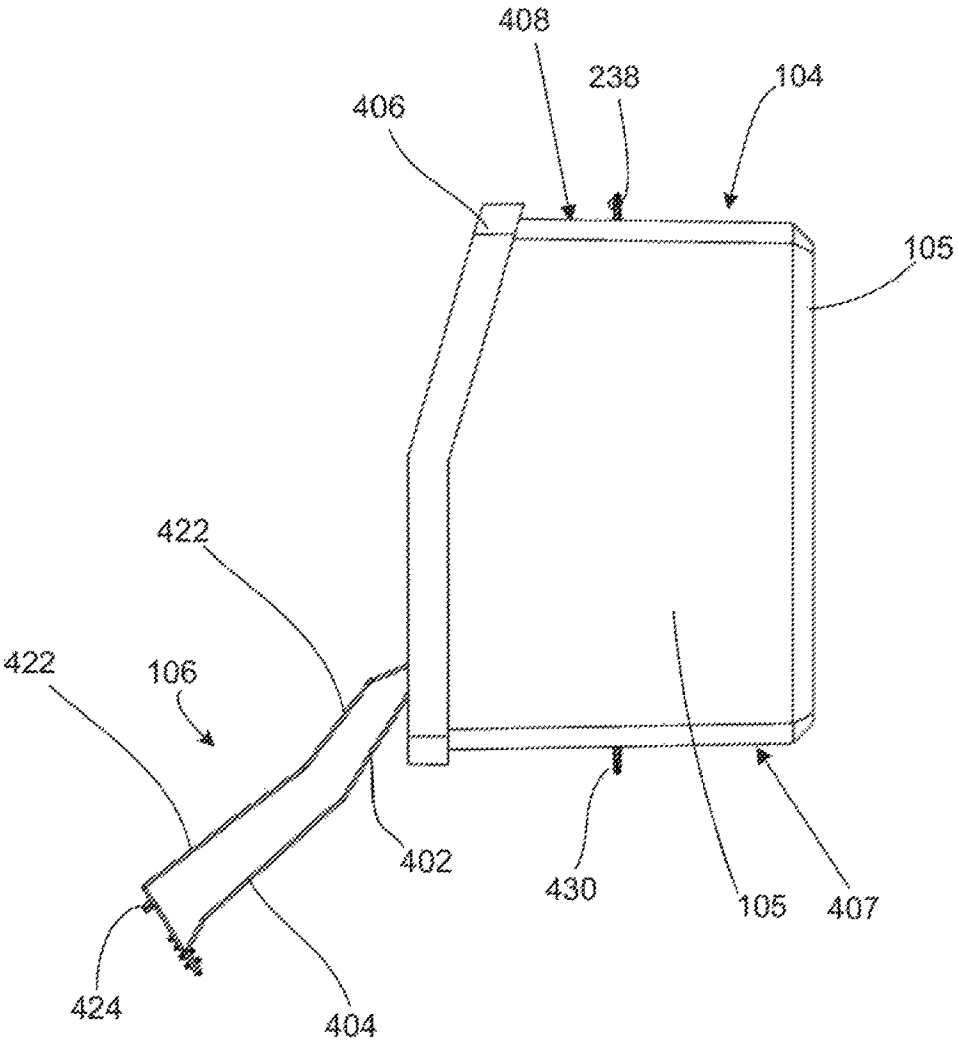
FIGS. 4C-4D are side views of the example cup of FIGS. 4A-4B with the example movable door in the closed position and the open position, respectively, in accordance with teachings of this disclosure.
Figure 4C:
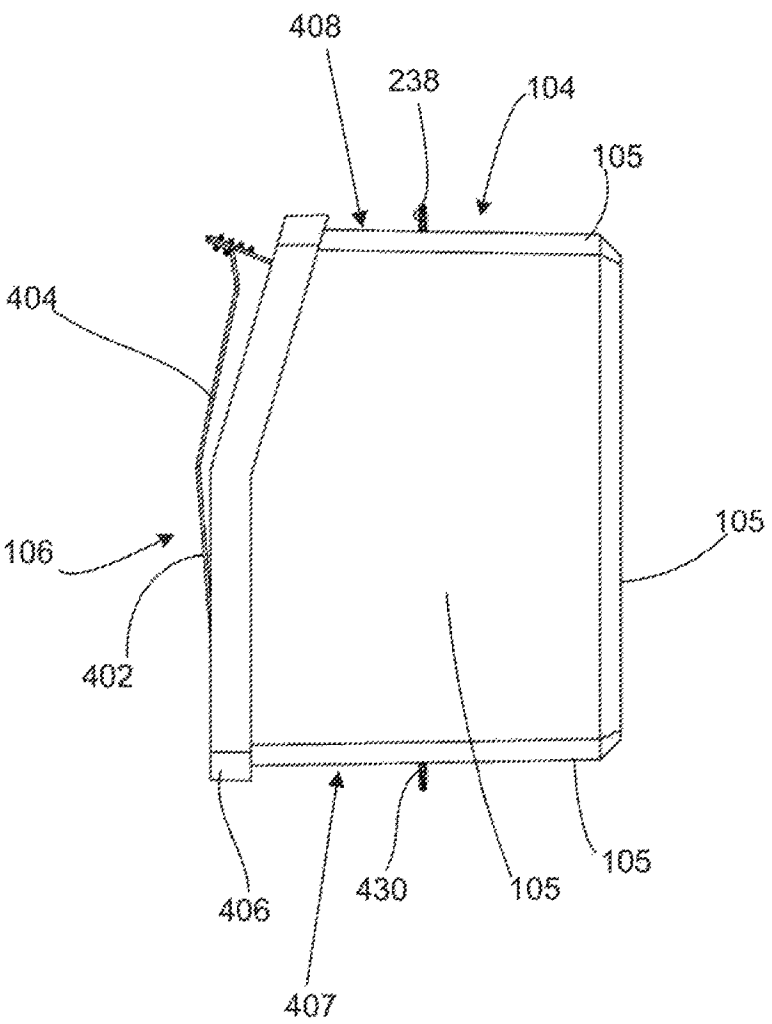

FIGS. 4C-4D are example side views of the example cup 104 of FIG. 1, FIGS. 2A-2G and FIGS. 4A-4B. FIG. 4C shows the movable door 106 of the cup 104 in a closed position and FIG. 4D shows the movable door 106 of the cup 104 an open position. In some examples, the movable door 106 includes an example lower portion 402 and an example upper portion 404 arranged at an angle relative to one another. For instance, as shown in FIG. 4C, the upper portion 404 is angled rearwardly (e.g., toward a rear of the cup 104) relative to the lower portion 402 to generally match a shape of the bezel 406 of the cup 104 and a shape of the cup 104. FIG. 4C shows the lower portion 407 of the cup 104 is larger (e.g., deeper, longer, etc.) that the upper portion 408. As noted above, this configuration facilitates stability of the cup 104 when the cup 104 is removed from the frame 102 and disposed on a surface. In the example of FIGS. 4C-4D, the lower portion 407 of the cup 104 includes an example feature 430 (e.g., a connector, a rib, a stand, a male member or protuberance, etc.) that extends downwardly by a height generally corresponding to that of a height of the bezel 406 from the bottom surface of the cup 104 to provide an additional line of contact between the cup 104 and a surface upon which the cup 104 rests. FIG. 4D the movable door 106 rotated into an open position and shows the features 422, which are to matingly engage the stop 420 of the cup 104 at one or more areas.

Figure 5:
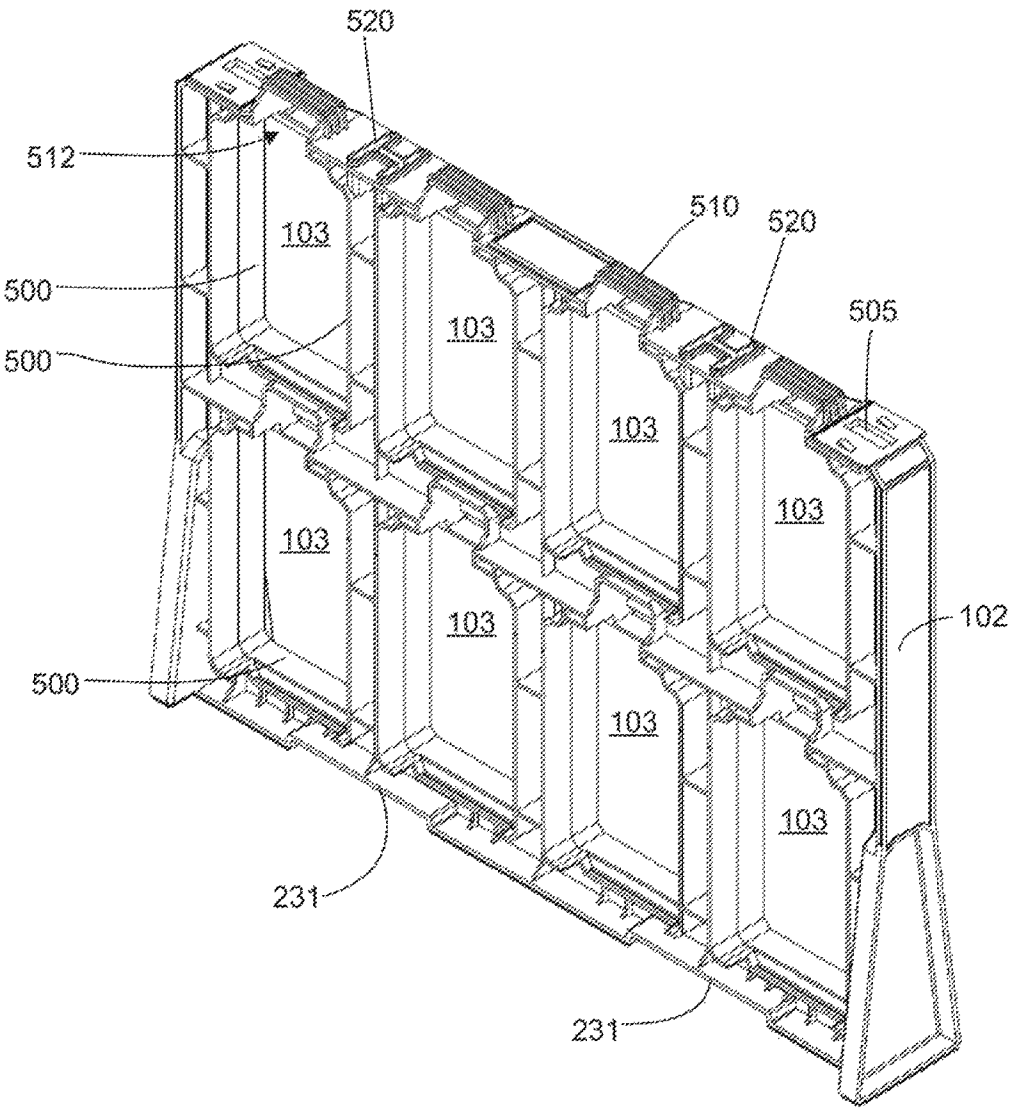
FIG. 5 is a perspective illustration of an example frame of the first organizer of FIG. 1 and FIGS. 2A-2G constructed in accordance with teachings of this disclosure.

FIG. 5 is a perspective illustration of an example frame 102 of the first organizer 100 of FIG. 1 and FIGS. 2A-2G. The frame 102 defines, vian example walls 500, a plurality of openings 103 that are to removably receive cups 104 therein. In some examples, the walls 500 define a plurality of uniform openings 103. In some examples, the walls 500 define a plurality of openings 103 of which at least one opening 103 is dissimilar in shape and/or size than another of the openings 103 to receive therein a cup 104 that is dissimilar in shape and/or size than another of the cups 104. FIG. 5 also shows the frame 102 to define example enclosures 510 within which the latches 114 are disposed. In some examples, the enclosures 510 serve to protect the latches 114, so as to reduce a potential for an inadvertent contact with, and delatching of, a latch 114 and serve to provide a reinforcement to the frame 102 around example openings 512 formed to receive the latches 114. FIG. 5 also shows example slots 520 to receive the handle 110. In some examples, the handle 110 and/or vertical arms of the handle 110 are integrally formed with the frame 102 and the slots 520 are omitted.

Figure 6A:
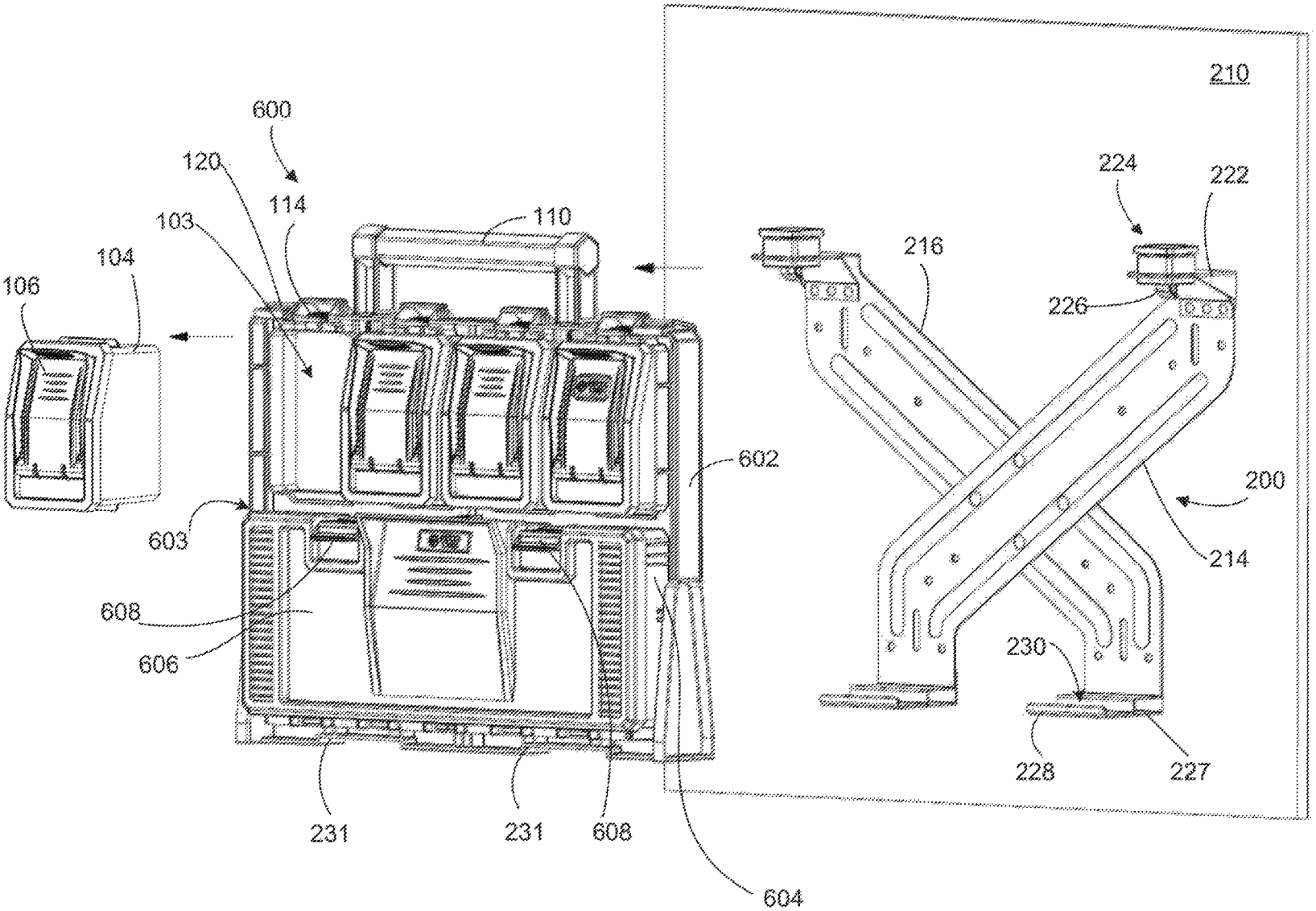
FIG. 6A is an exploded perspective illustration of an example second organizer showing example removable cups and showing an example wall mount bracket in accordance with teachings of this disclosure.

FIG. 6A is an exploded perspective illustration of an example second organizer 600 showing removable cups 104 similar to those shown in FIGS. 1-5 and an example wall mount bracket 200 similar to those shown in FIGS. 2A-5. As with FIG. 2A, FIG. 6A shows the second organizer 600 in relation to the wall mount bracket 200 attached to an example wall 210 and shows a cup 104 removed from a corresponding opening 103 of the second organizer 600. However, whereas the frame 102 (see FIG. 2A) includes a plurality of openings 103 formed in the lower portion 112 of the frame 102 (see FIG. 2A), the second organizer 600 omits the plurality of openings 103 in the lower portion 112 of the frame 602 in favor of a single opening 603 including an example receptacle 604. In some examples, the example receptacle 604 is fixed to the frame 602. In some examples, the receptacle 604 is removably attached to the frame 602. In some examples, the receptacle 604 is removably attached to the frame 602 in a similar manner to that of the cups 104 (e.g., via one or more latches 114, etc.). In some examples, the receptacle 604 is removably attached to the frame 602 in a manner different than that of the cups 104 (e.g., via one or more male/female connectors and/or snap-fit connectors, etc.). The receptacle 604 includes an example movable door 606. In some examples, the movable door 606 and/or the frame 602 includes example latches 608 to secure the movable door 606 relative to the receptacle 604. In some examples, the movable door 606 includes one or more snap-fit connectors to engage with corresponding mating snap-fit connectors formed in the receptacle 604 to lock the movable door 606 in place in a closed position. In some examples, the movable door 606 frictionally engages the receptacle 604 to provide resistance to movement of the movable door 606 along a portion of a range of angular movement of the movable door 606 (e.g., along the first 5°-10° of movement of the movable door in the opening direction, etc.) or along an entire range of angular movement.

Figure 6B:
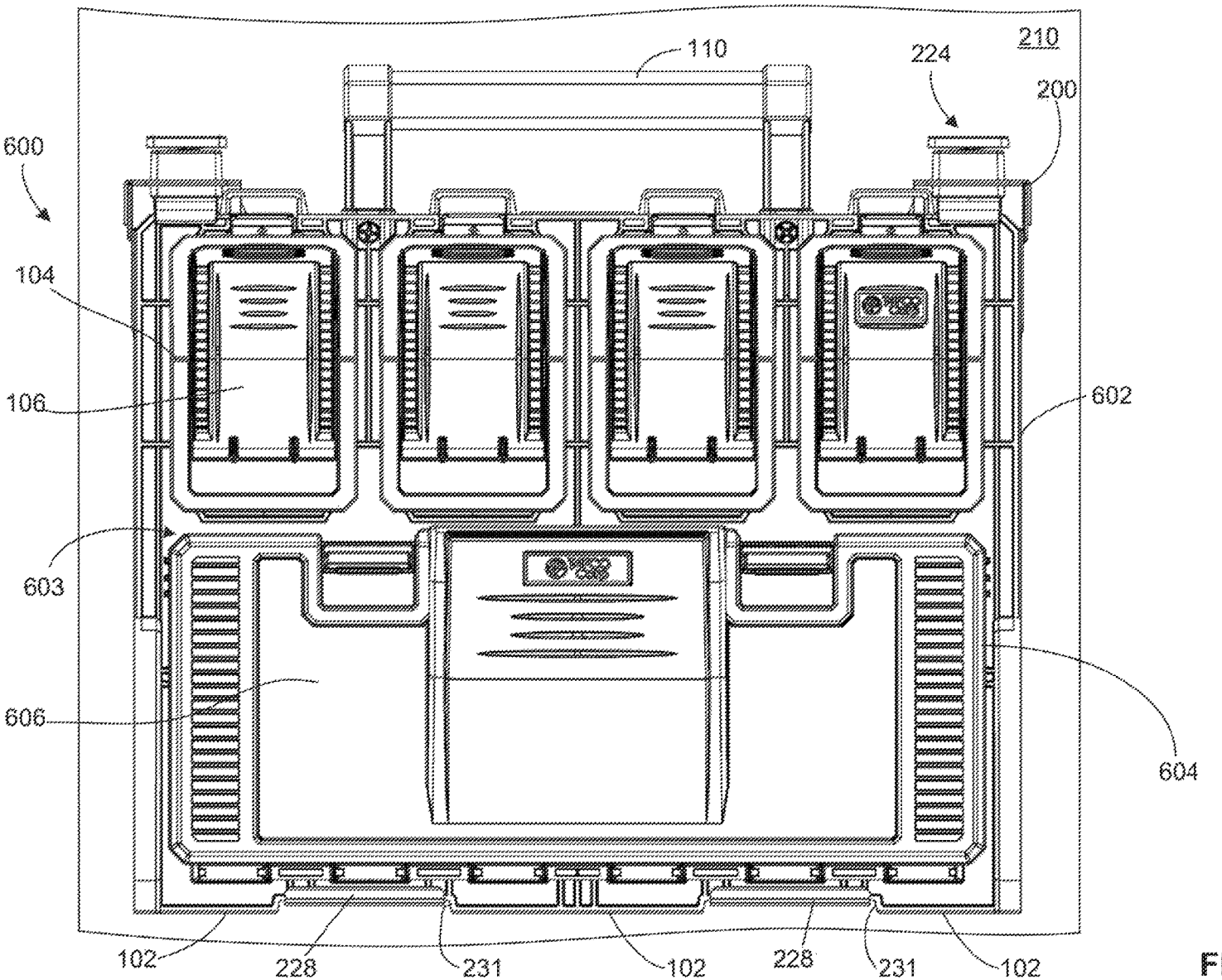
FIG. 6B is a front view of the second organizer of FIG. 6A removably attached to the wall mount bracket of FIG. 6A in accordance with teachings of this disclosure.

FIG. 6B is a front view of the second organizer 600 of FIG. 6A removably attached to the wall mount bracket 200 of FIG. 6A. FIG. 6B shows engagement of the frame 602 by the lateral retainers 228 at a lower portion of the first organizer 100 and engagement of the adapters 120 of the frame 602 by the quick release connectors 224 at an upper portion of the first organizer 100.

Figure 6C:
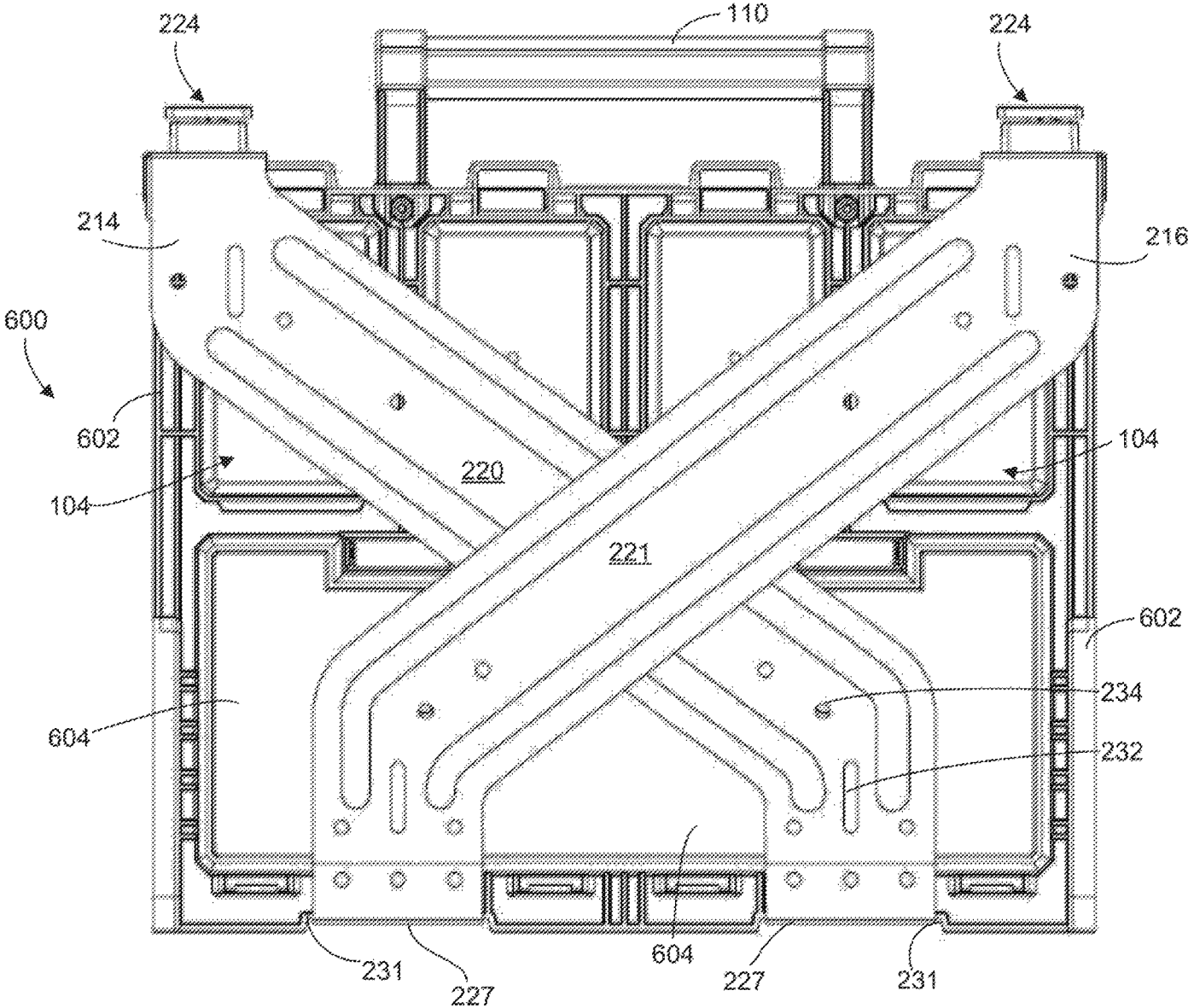
FIG. 6C is a rear view of the second organizer of FIGS. 6A-6B removably attached to the wall mount bracket of FIGS. 6A-6B, with the example wall removed for clarity, in accordance with teachings of this disclosure.

FIG. 6C is a rear view of the second organizer 600 of FIGS. 6A-6B removably attached to the wall mount bracket 200 of FIGS. 6A-6B, with the example wall removed for clarity. FIG. 6C shows the first section 214 and the second section 216 of the wall mount bracket 200, as well as the slots 232 and through holes 234 by which the wall mount bracket 200 may be mounted to the wall. In some examples, the wall mount bracket 200 may omit the example slots 232 and through holes 234 in favor or an adhesive connection between the wall mount bracket 200 and the wall. FIG. 6C also shows the openings 103 defined by the frame 602 to receive the cups 104. In some examples, the wall mount bracket 200 is omitted and the second organizer 600 is mounted to the wall via a bracket or hanger that engages the handle 110 or other feature of the frame 602. For instance, the second organizer 600 may be placed in or attached to a hanger hook or a clamp mounted to the wall.

Figure 6D:
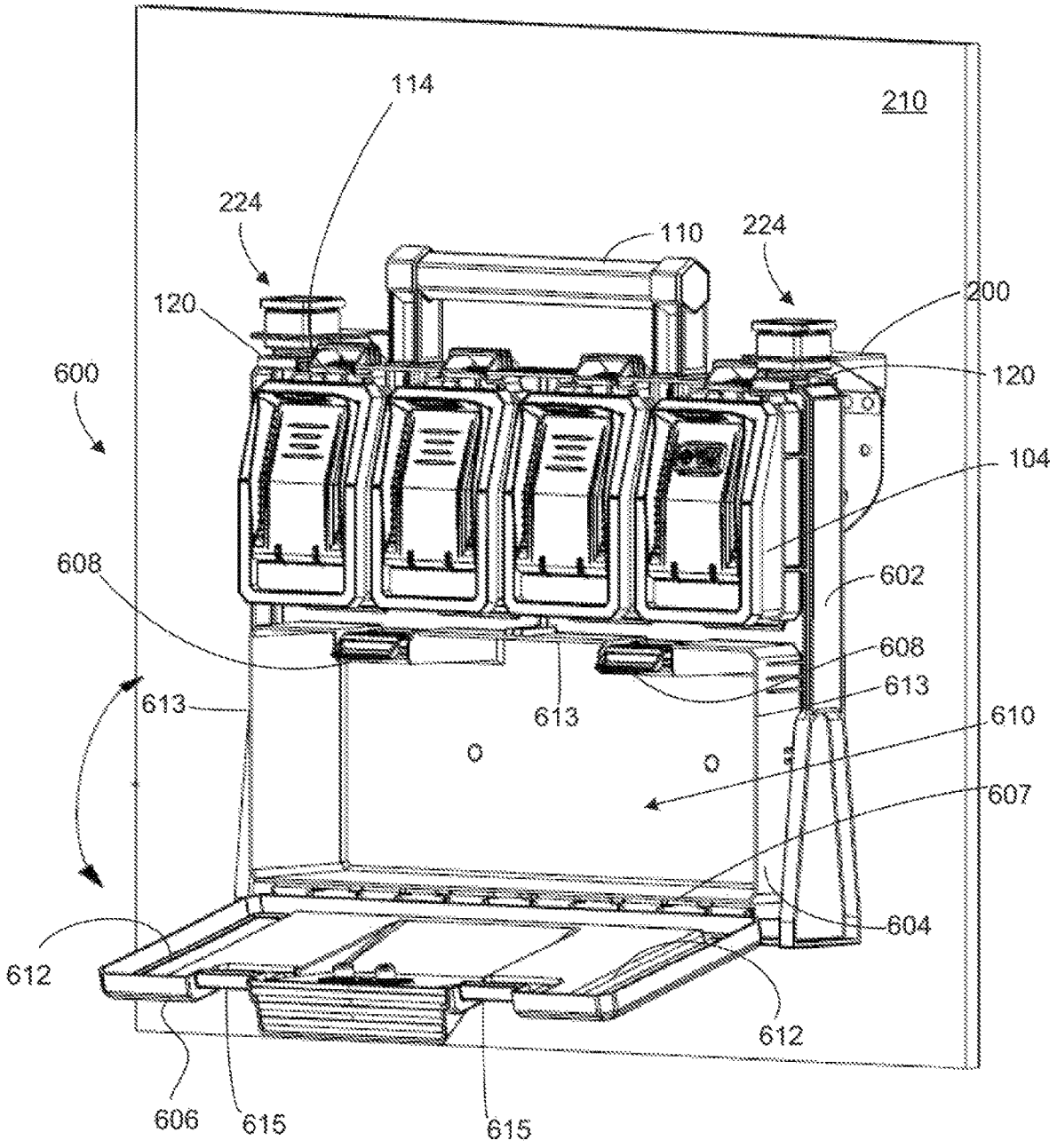
FIG. 6D is a perspective illustration of the second organizer of FIGS. 6A-6C, attached to the wall mount bracket of FIGS. 6A-6C, in accordance with teachings of this disclosure with a movable door of a receptacle at a lower portion of the second organizer being shown in an open position.

FIG. 6D is a perspective illustration of the second organizer 600 of FIGS. 6A-6C, attached to the wall mount bracket 200 of FIGS. 6A-6C. In FIG. 6D, the movable door 606 of the receptacle 604 is in an open position, showing the example hinge 607 about which the movable door 606 rotates relative to the receptacle 604 and showing the example interior volume 610. In some examples, inner surfaces of the movable door 606 define example features 612, such as grooves or recesses, configured to matingly receive and/or matingly engage corresponding features 613 of the receptacle 604. For example, the features 612 of the movable door 606 includes grooves configured to receive features 613 (e.g., edges) of the receptacle 604. Example latches 608 of the receptacle 604 are rotatably provided adjacent the receptacle 604 to removably engage corresponding example connectors 615 on the movable door 606. In some examples, the latches 608 include a first snap-fit element and the connectors 615 include a second snap-fit element, with the first snap-fit element matingly engaging the second snap-fit element when the movable door 606 is in the fully closed position and the latches 608 are rotated downwardly to engage the first snap-fit element to the second snap-fit elements. In some examples, the latches 608 are omitted and the movable door 606 includes one or more connection elements (e.g., snap-fit connector, male connector, etc.) to matingly engage correspondingly configured (e.g., snap-fit connector, female connector, etc.) connection elements of the receptacle 604. In some examples, the latches 608 are omitted and the movable door 606 includes one or more connection elements (e.g., groove, etc.) dimensioned to engage, via a friction fit (e.g., a location fit, a sliding fit, etc.), mating connection elements of the receptacle 604, wherein a light amount of force (e.g., opened by hand with little effort, etc.) is sufficient to lock the movable door 606 in a closed position or to open the movable door 606 from the closed position.

Figure 7:
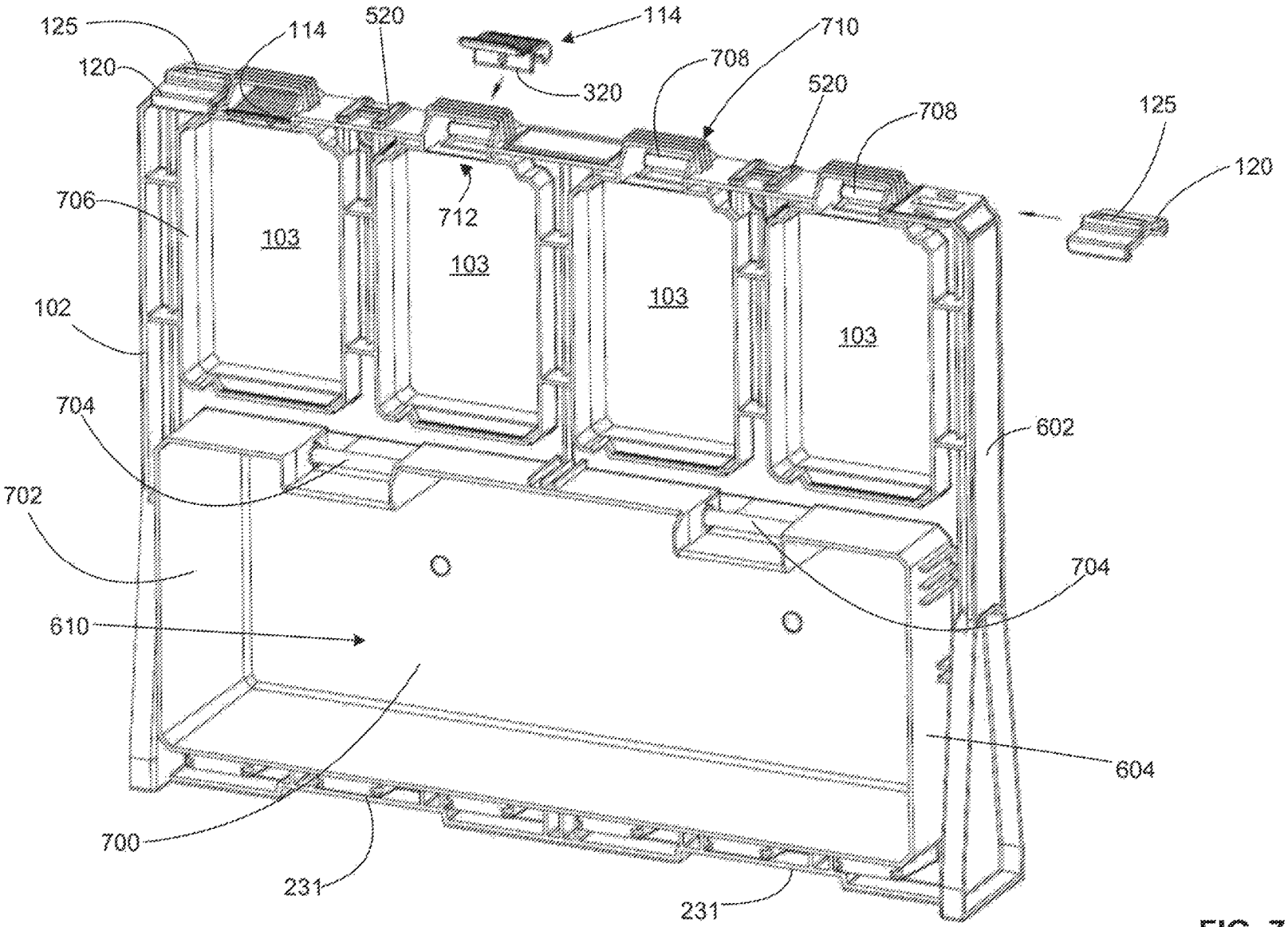
FIG. 7 is a perspective illustration of an example frame of the second organizer of FIGS. 6A-6D constructed in accordance with teachings of this disclosure.

FIG. 7 is a perspective illustration of the example frame 602 of the second organizer 600 of FIGS. 6A-6D. The frame 602 defines the receptacle 604 vian example walls 700, 702. The frame 602 and/or the receptacle 604 include example connectors 704, which are cylindrical in the depicted example, to which the latches 608 are rotatably attached. The frame 602 defines the openings 103 vian example walls 706. The frame 602 includes example connectors 708, which are cylindrical in the depicted example, to which the latches 114 are rotatably attached. In some examples, the walls 706 define a plurality of openings 103 of which at least one opening 103 is dissimilar in shape and/or size than another of the openings 103 to receive therein a cup 104 that is dissimilar in shape and/or size than another of the cups 104. FIG. 7 shows the frame 602 to define example enclosures 710 within which the latches 114 are disposed. In some examples, the enclosures 710 serve to protect the latches 114, so as to reduce a potential for an inadvertent contact with, and delatching of, a latch 114 and serve to provide a reinforcement to the frame 602 around example openings 712 formed to receive the latches 114. FIG. 7 shows the adapter 120 is a separate component that is attached to the frame 602 via mechanical fasteners (e.g., snap-fit connectors, etc.) and/or adhesive.

Figure 8:
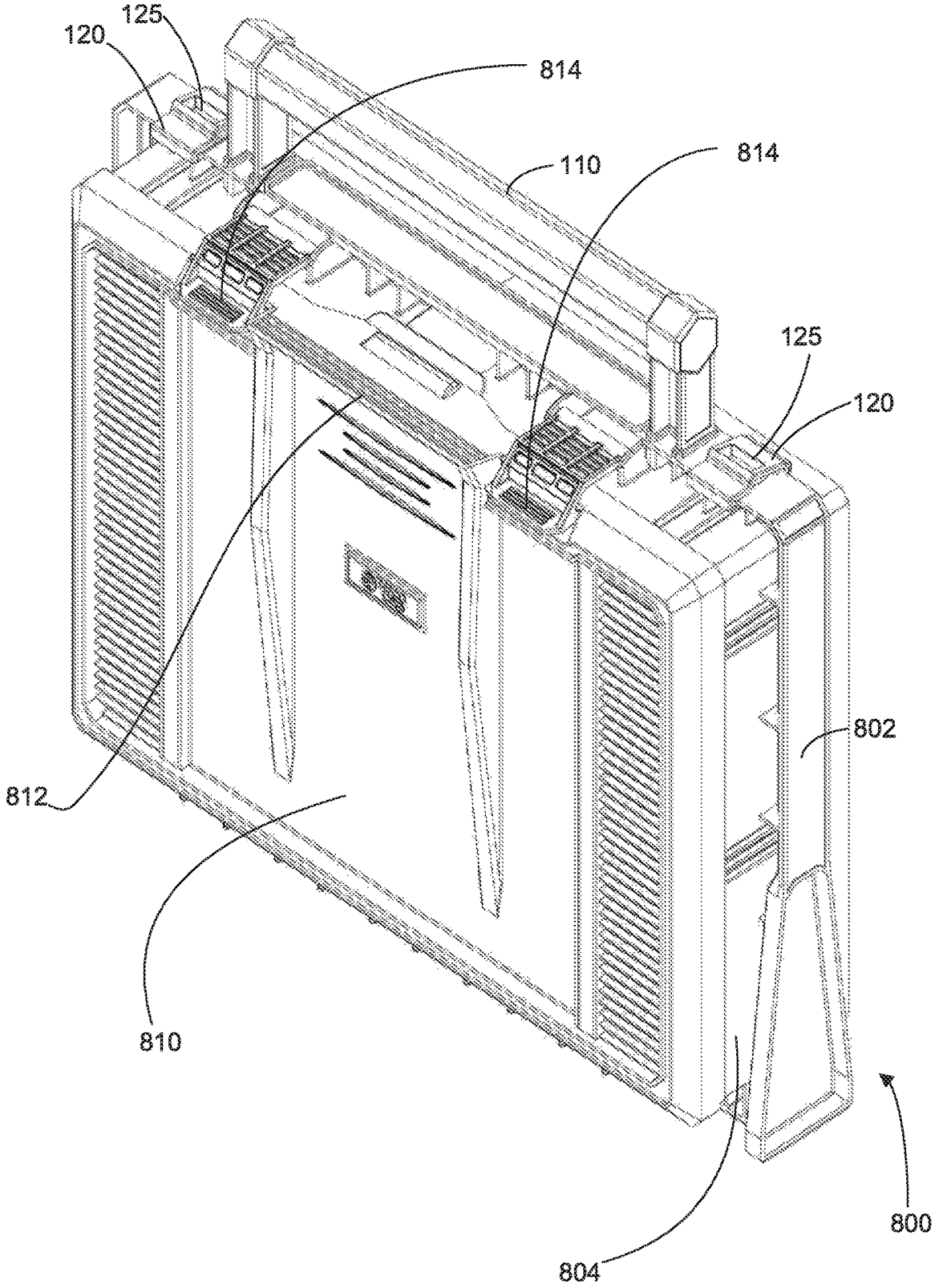
FIG. 8 is a perspective illustration of an example third organizer in accordance with teachings of this disclosure.

FIG. 8 is a perspective illustration of an example third organizer 800 including an example frame 802, an example receptacle 804, an example movable door 810, an example hinge 811 about which the movable door 810 rotates, an example handle 812 that may be used to manipulate the movable door 810 relative to the receptacle 804, and example latches 814 movable (e.g., rotatable, etc.) to secure the movable door 810 relative to the receptacle 804. The frame 802 of the third organizer 800 includes adapters 120 and/or features facilitating connection of the third organizer 800 to a wall mount bracket 200 similar to that shown, by way of example, in FIGS. 2A and 6A, with respect to the first organizer 100 and the second organizer 600.

Figure 9:
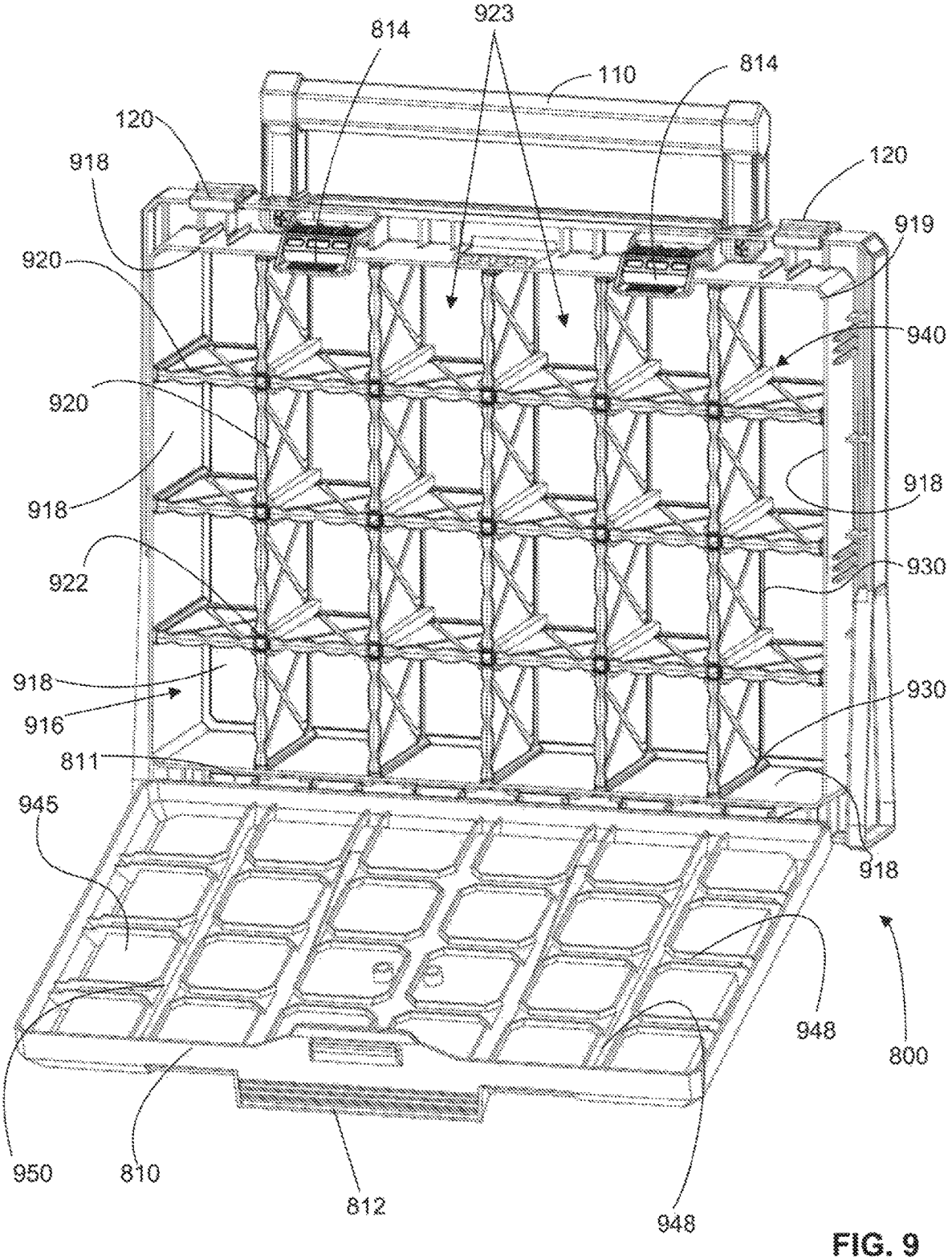
FIG. 9 is a perspective illustration of the third organizer of FIG. 8 with a movable door shown in an open position to show an example interior volume of the third organizer in an example first configuration in accordance with teachings of this disclosure.

FIG. 9 is a perspective illustration of the third organizer 800 of FIG. 8 with the movable door 810 in an open position showing an example interior volume 916 defined by example walls 918 of the third organizer 800. The receptacle 804 walls 918 likewise define an example opening 919 to the interior volume 916. The movable door 810 is to move between an open position, as shown in FIG. 9, in which the interior volume 916 is accessible via the opening 919 and a closed position, as shown in FIG. 8, in which the opening 919 is occluded.

Example removable partitions 920 and example removable posts 922 subdivide the interior volume 916 into a plurality of example compartments 923. As shown in FIG. 9, the interior volume 916 is arranged in an example first configuration, an example 4×6 array, defining twenty-four compartments 923. The walls 918 include a plurality of example first features 930 (e.g., slots, grooves, snap-fit connectors, female connectors, male connectors, etc.) to removably receive the removable partitions 920 and include a plurality of example second features 940 to removably receive the removable posts 922, such first features 930 and second features 940 being described further below in relation to the examples illustrated in FIGS. 10-13B.

In some examples, an interior surface 945 of the movable door 810 is substantially planar. In some examples, the interior surface 945 of the movable door 810 includes example third features 948 (e.g., slots, grooves, snap-fit connectors, female connectors, male connectors, etc.) that matingly engage upper ends (e.g., upper surfaces of or upper portions of, etc.) of the removable partitions 920 to provide lateral support to the upper end of the removable partitions 920 when the movable door 810 is in the closed position. In some examples, the interior surface 945 of the movable door 810 includes example fourth features 950 (e.g., slots, grooves, snap-fit connectors, female connectors, male connectors, etc.) that matingly engage upper ends (e.g., upper surfaces of or upper portions of, etc.) of the removable posts 922 to provide lateral support to the upper end of the removable posts 922 when the movable door 810 is in the closed position. In the example of FIG. 9, the third features 948 include slots arranged in a grid pattern and the fourth features 950 include recesses disposed at intersections of the grid pattern of the third features 948.

The third organizer 800 is constructed to enable selective customization of the interior volume 916 by securing a lower end of one or more removable posts 922 to a selected one or more of the plurality of second features 940, by securing a lateral end of one or more removable partitions 920 to a lateral portion of the one or more removable posts 922, and by securing a lower end of the one or more removable partitions 920 to one or more first features 930 adjacent the one or more removable posts 922.

Figure 10:
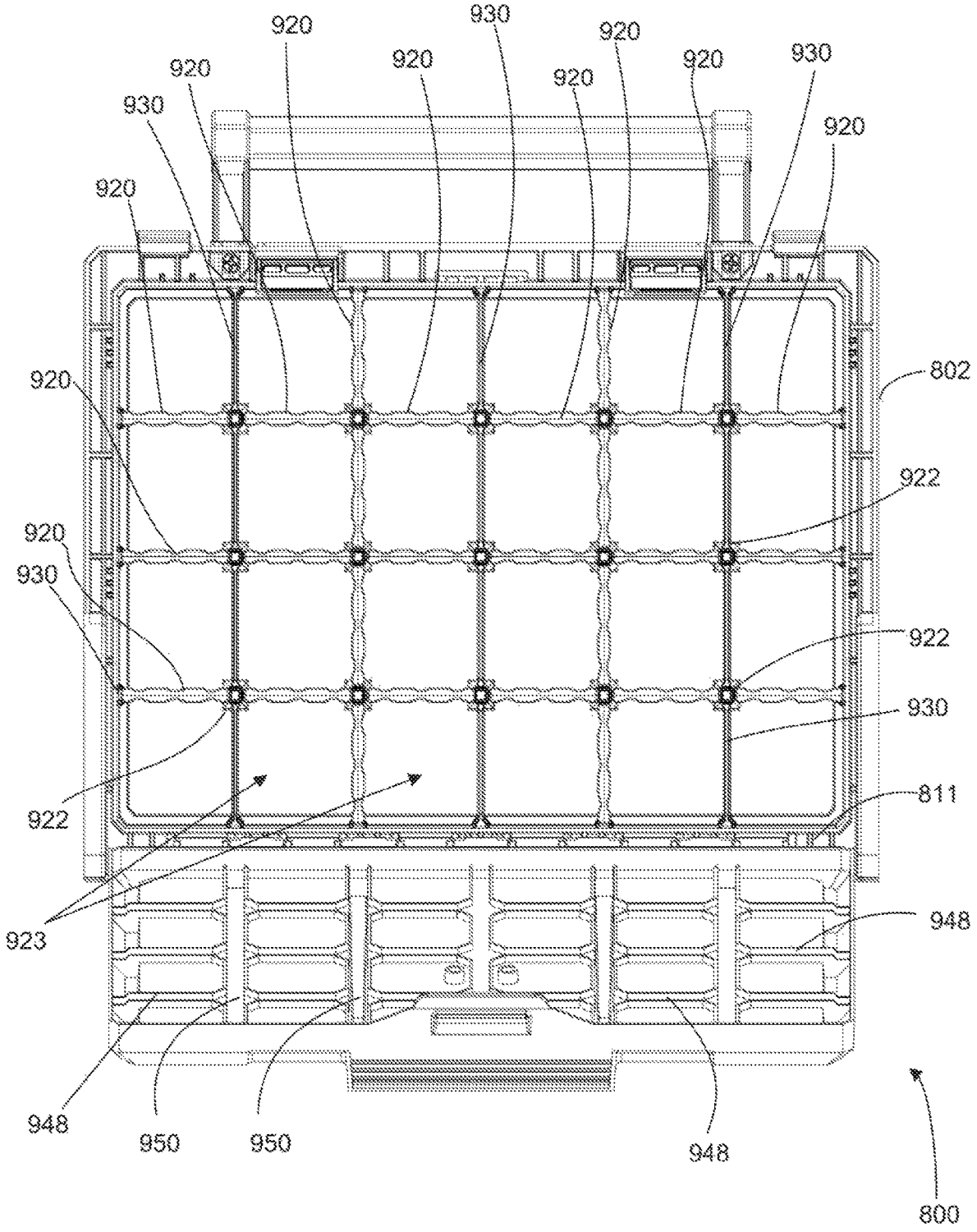
FIG. 10 is a front view of the third organizer of FIG. 9 with the movable door shown in the open position to show the example interior volume of the third organizer in an example second configuration in accordance with teachings of this disclosure.

To illustrate, FIG. 10 is a front view of the third organizer 800 of FIGS. 8-9 with the movable door 810 in the open position to show the interior volume 916 of the third organizer 800 in an example second configuration. Whereas FIG. 9 showed a first configuration including removable partitions 920 and removable posts 922 defining a 4×6 array of twenty-four equally sized compartments 923, FIG. 10 shows the example second configuration including removable partitions 920 and removable posts 922 defining a 3×4 array of twelve equally sized compartments 923. The third organizer 800 may be customized from an initial state to a subsequent state by selective removal or and/or additional of removable partitions 920 and/or posts 922. For instance, a transition from the first configuration of FIG. 9 to the second configuration of FIG. 10 would require selective removal of twelve removable partitions 920.

Figure 11:
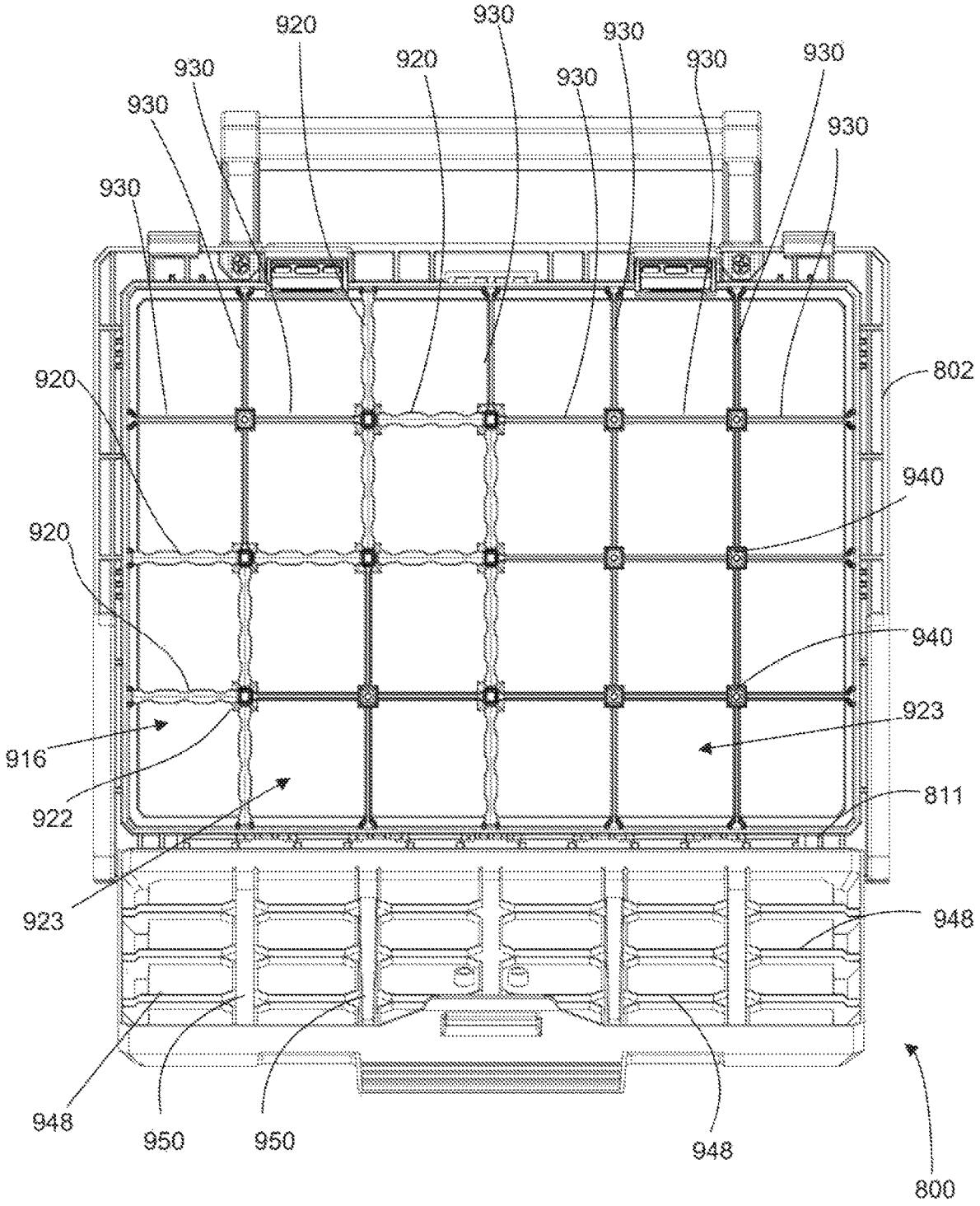
FIG. 11 is a front view of the third organizer of FIG. 9 with the movable door shown in the open position to show the example interior volume of the third organizer in an example third configuration in accordance with teachings of this disclosure.

FIG. 11 is a front view of the third organizer 800 of FIG. 9 with the movable door 810 in the open position to show the interior volume 916 of the third organizer 800 in an example third configuration. FIG. 11 shows the example third configuration including removable partitions 920 and removable posts 922 defining six compartments 923 including three 1×1 compartments, two 4×4 compartments, and one larger compartment occupying more than half of the interior volume 916

Figure 12:
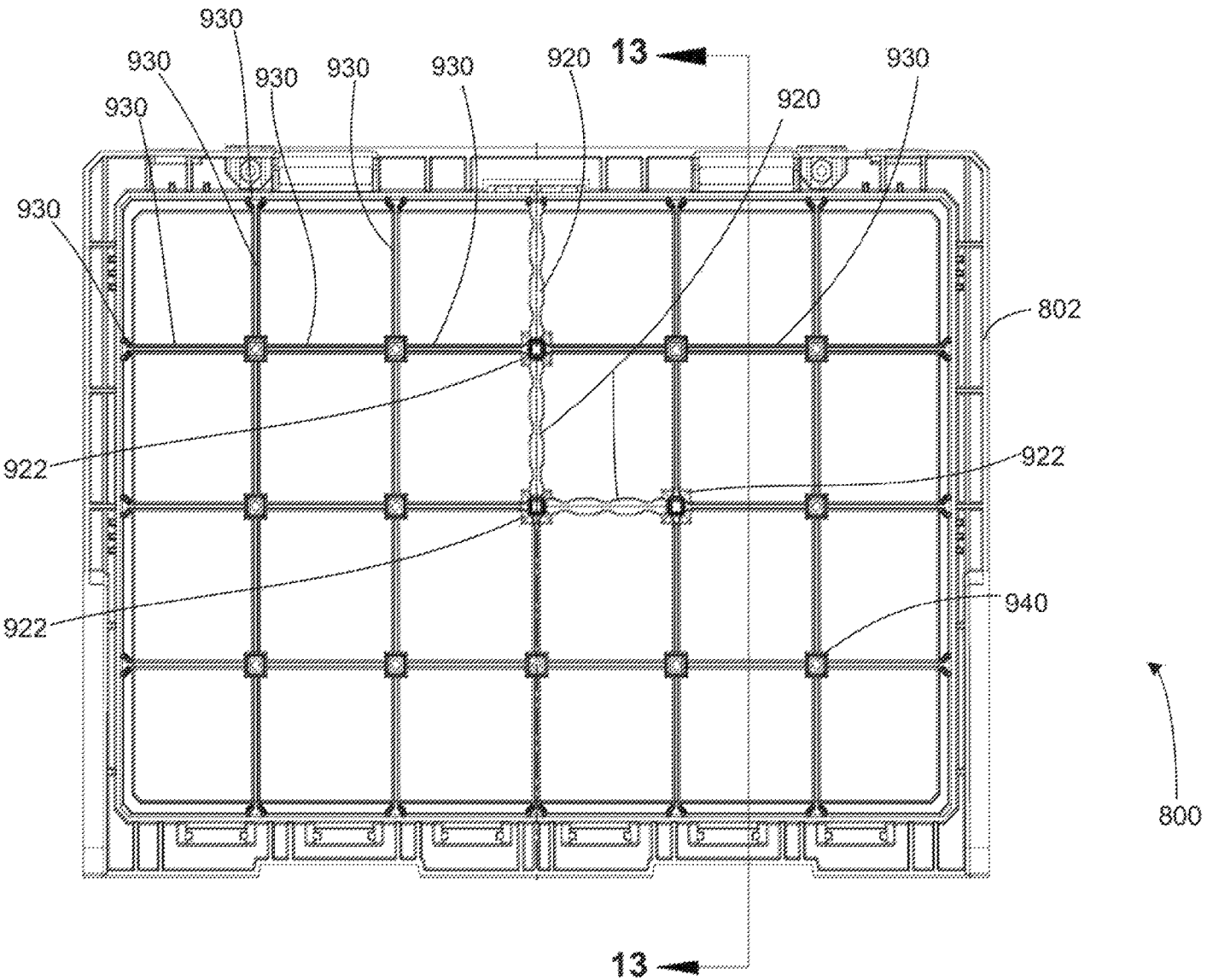
FIG. 12 is a front view of the third organizer of FIG. 9 with the movable door removed for clarity to show the example interior volume of the example third organizer in an example fourth configuration in accordance with teachings of this disclosure.

FIG. 12 is a front view of the third organizer 800 of FIG. 9 with the movable door removed for clarity to show the interior volume 916 of the third organizer 800 in an example fourth configuration. The fourth configuration of FIG. 12 shows three removable partitions 920 and three removable posts 922 arranged to form a partition within the interior volume 916.

Figure 13A:
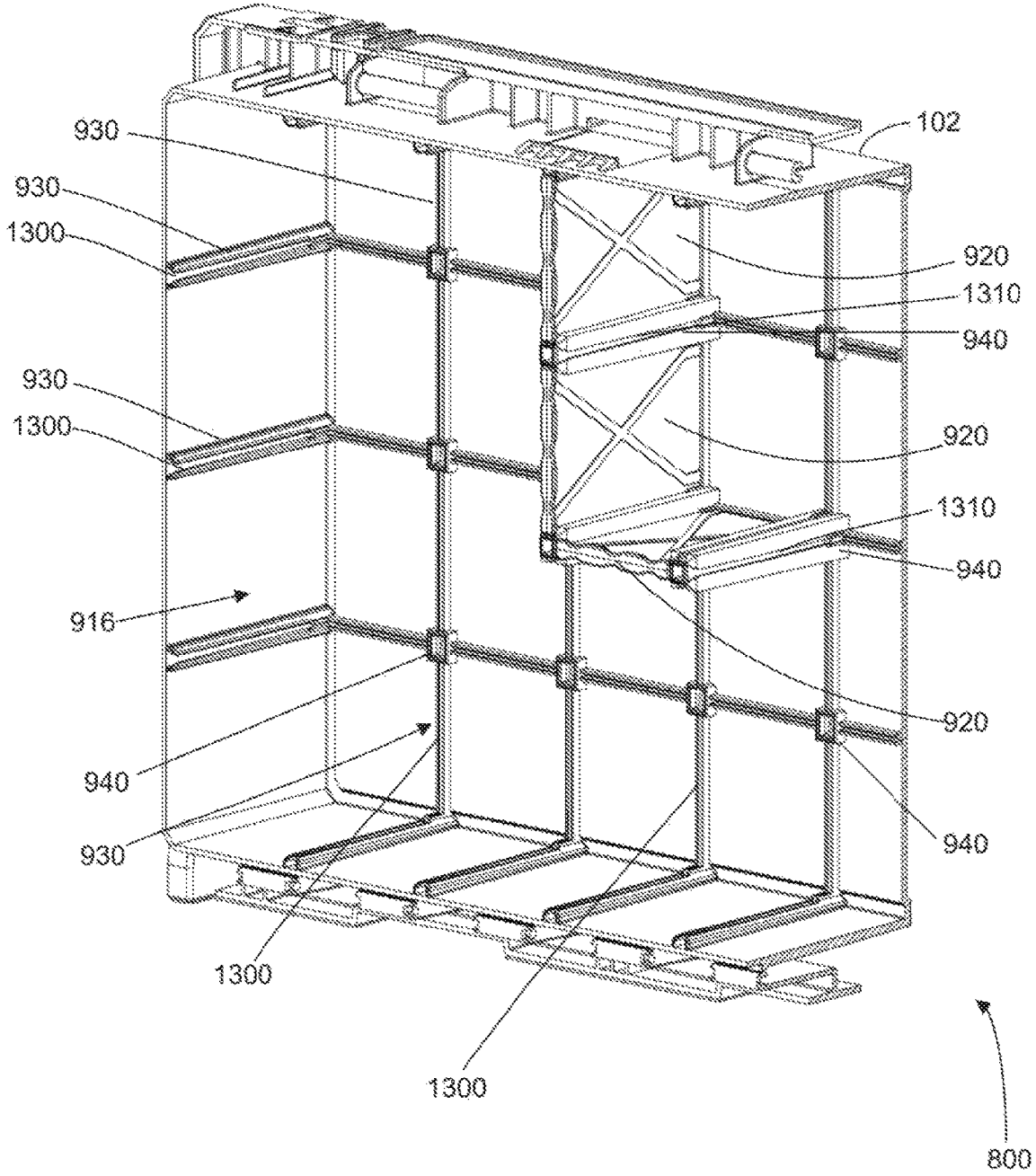
FIG. 13A is a partial perspective illustration of the third organizer of FIG. 12, showing the example interior volume of the example third organizer in the example fourth configuration, in accordance with teachings of this disclosure.

FIG. 13A is a partial perspective illustration of the third organizer 800 of FIG. 12, showing the interior volume 916 of the third organizer 800 in the example fourth configuration. FIG. 13A shows additional details of the example first features 930 to removably receive the removable partitions 920 and the example second features 940 to removably receive the removable posts 922. The first features 930 of FIG. 13A include example slots 1300 into which lateral portions of the removable partitions 920 (e.g., a lateral portion of the removable partition, an entire lateral side of the removable partition, etc.) are received and retained. The second features 940 of FIG. 13A include example slots 1310 into which lateral portions of the removable partitions 920 (e.g., a lateral portion of the removable partition, an entire lateral side of the removable partition, etc.) are received and retained.

Figure 13B:
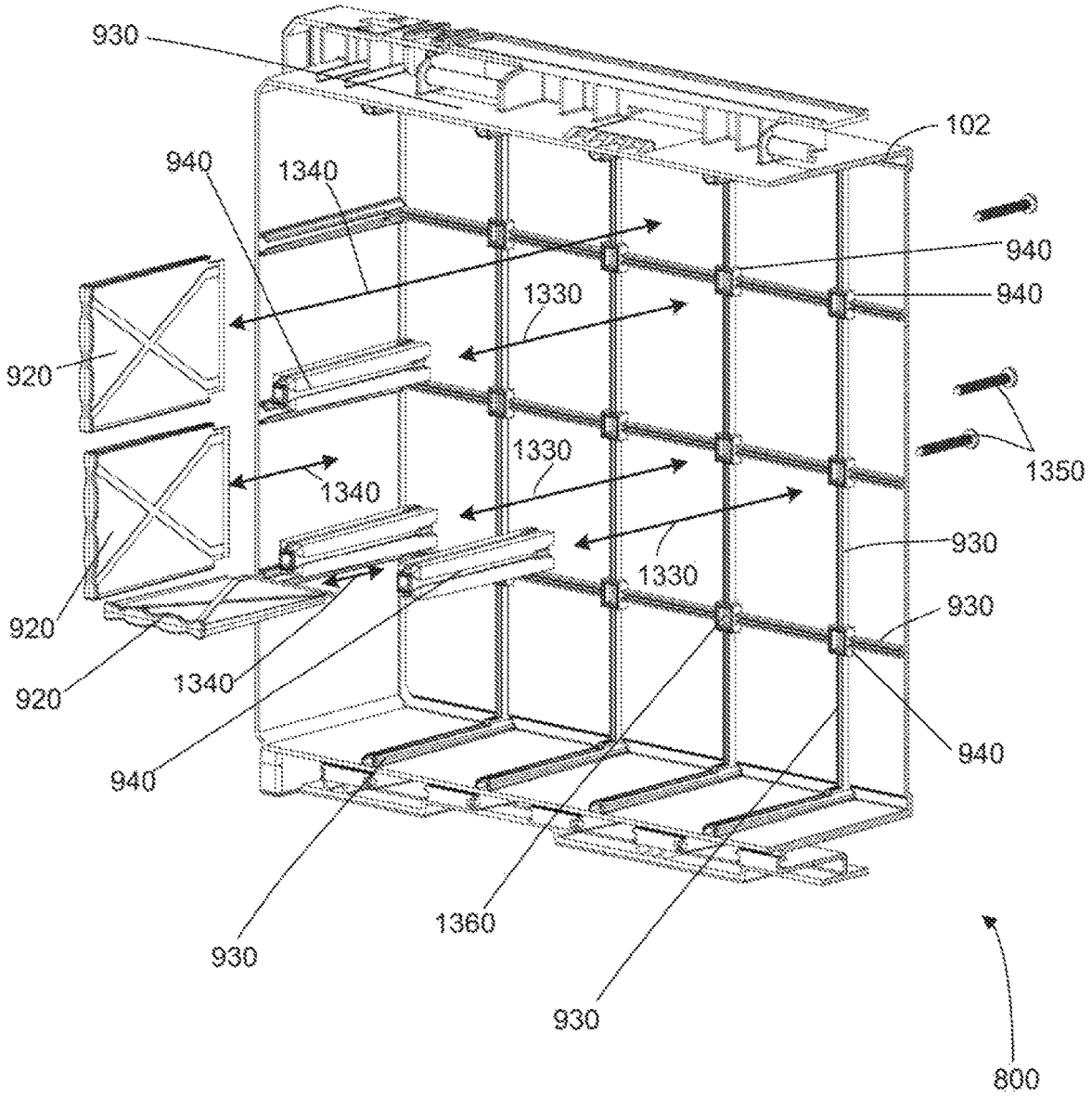
FIG. 13B is an exploded view of the third organizer of FIG. 13A, showing the example interior volume of the third organizer in the example fourth configuration in relation to a plurality of example first features and a plurality of example removable partitions received thereby and in relation to a plurality of example second features and a plurality of example removable posts received thereby, in accordance with teachings of this disclosure.

FIG. 13B is an exploded view of the third organizer 800 of FIG. 13A, showing the interior volume 916 of the third organizer 800 in the example fourth configuration of FIGS. 12-13A. FIG. 13B shows the second features 940 in relation to the removable posts 922 in an assembly or disassembly operation indicated by the example arrows 1330. FIG. 13B also shows the first features 930 in relation to the removable partitions 920 in an assembly or disassembly operation indicated by example arrows 1340. In some examples, following positioning of the removable posts 922 in the selected second features 940, example mechanical fasteners 1350 are inserted through example openings 1360 in the second features 940 and into a bottom portion of the removable posts 922 (e.g., via a threaded hole in a bottom portion of the removable posts 922 to receive a screw, etc.). In some examples, the removable posts 922 are connected to the second features via a male/female connector and/or a snap-fit connector rather than through a separate mechanical fastener.

The disclosed examples of FIGS. 1-13B illustrate a user-configurable organizer system configurable to individual preferences and/or job-specific requirements. Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An organizer, comprising:

a plurality of cups, each of the plurality of cups including a front wall, a rear wall, a first lateral wall, a second lateral wall, a base, and a top collectively defining an interior volume, each of the plurality of cups including, in the front wall, a first opening to the interior volume and a movable door movably disposed in said first opening, each of the plurality of cups further including a first connector on an exterior portion of at least one of the rear wall, first lateral wall, second lateral wall, base, or top, the movable door being constructed to move between an open position in which the interior volume is accessible via the first opening and a closed position in which the first opening is occluded; and a freestanding vertical frame comprising, at an upper portion, lateral members having a first depthwise dimension and comprising, at a lower portion, support members having a second depthwise dimension greater than the first depthwise dimension to define a base, the frame further defining a plurality of second openings extending depthwise through the frame to correspondingly receive the plurality of cups in an orientation wherein each of the plurality of cups is at least substantially centered depthwise within the freestanding vertical frame and wherein the movable door of each of the plurality of cups is positioned at a front side of the frame to enable access to the interior volume of each of the plurality of cups from the front side of the frame, via the movable door, when the freestanding vertical frame is disposed at least in an upright vertical orientation, the freestanding vertical frame including a second connector adjacent each of the plurality of second openings to engage the first connector of a cup when the cup is positioned within the respective one of the plurality of second openings and to secure the cup to the freestanding vertical frame.

2. The organizer of claim 1, wherein the plurality of second openings are arranged in an array.

3. The organizer of claim 2, wherein the array of second openings includes a 4×1 array of second openings at a first portion of the freestanding vertical frame.

4. The organizer of claim 3, wherein the array of second openings includes a 4×1 array of second openings at a second portion of the freestanding vertical frame.

5. The organizer of claim 1, wherein the first connector includes a male connector and the second connector includes a female connector or wherein the first connector includes a female connector and the second connector includes a male connector.

6. The organizer of claim 5, wherein the first connector includes a first rib and wherein the second connector includes a latch to engage the first rib.

7. The organizer of claim 6, wherein the cup includes a second rib on a portion of the cup opposite to the first rib, and wherein the first rib and the second rib are to engage portions of the freestanding vertical frame defining the second opening to position the cup within the second opening to enable engagement of the first rib by the latch.

8. The organizer of claim 1, further including a wall mount bracket including a third connector, wherein the freestanding vertical frame includes a fourth connector and wherein the wall mount bracket is to receive and releasably secure the freestanding vertical frame in a vertical orientation with the front side of the freestanding vertical frame facing away from the wall mount bracket so the movable doors of the plurality of cups are positioned to enable access to the interior volume from the front side of the freestanding vertical frame when the movable door is in the open position and while the frame is mounted on the wall mount bracket, via engagement of the third connector and the fourth connector.

9. The organizer of claim 8, wherein the third connector or the fourth connector includes a male connector and another of the third connector or the fourth connector includes a female connector.

10. The organizer of claim 8, wherein the third connector or the fourth connector includes a quick release connector or a snap-fit connector.

11. The organizer of claim 8, wherein the wall mount bracket includes a base to mount to a wall and a cantilevered arm extending outwardly from the base to receive and support the freestanding vertical frame.

12. The organizer of claim 1, wherein the base of each of the plurality of cups has a larger cross-sectional area than the top of the cup and wherein the movable door in the first opening of the front wall is movably connected to the cup via a hinge.

13. The organizer of claim 2, wherein the array of second openings includes a 2×1 array of second openings at an upper portion of the freestanding vertical frame.

14. The organizer of claim 2, wherein the array of second openings includes a 3×1 array of second openings at an upper portion of the freestanding vertical frame.

15. The organizer of claim 1, wherein the first connector or the second connector comprise a latch.

16. The organizer of claim 1, wherein the front of each of the plurality of cups comprises a bezel, a bottom of the bezel extending below the bottom of the cup by a first distance, and wherein the first connector comprises a first rib extending downwardly from an exterior portion of the bottom of the cup by the first distance.

17. The organizer of claim 8, wherein the third connector is disposed at a bottom portion of the wall mount bracket, and wherein the fourth connector is disposed at a bottom portion of the freestanding vertical frame.

18. The organizer of claim 17, wherein the fourth connector comprises a first recess and a second recess spaced apart along the bottom portion of the freestanding vertical frame.

19. The organizer of claim 18, wherein the third connector comprises a first cantilevered arm and a second cantilevered arm, each extending outwardly from the bottom portion of the base to receive and respectively support the freestanding vertical frame at the first recess and the second recess.

20. The organizer of claim 19, wherein the wall mount bracket first cantilevered arm and second cantilevered arm are configured to bear an entire weight of the freestanding vertical frame and the plurality of cups borne thereby.

* * * * *